US009162138B2

(12) United States Patent
Grauzer et al.

(10) Patent No.: US 9,162,138 B2
(45) **Date of Patent: *Oct. 20, 2015**

(54) CARD-READING SHOE WITH INVENTORY CORRECTION FEATURE AND METHODS OF CORRECTING INVENTORY

(71) Applicant: Bally Gaming, Inc., Las Vegas, NV (US)

(72) Inventors: Attila Grauzer, Las Vegas, NV (US); Roger M. Snow, Las Vegas, NV (US); James R. Roberts, North Las Vegas, NV (US); James P. Jackson, Henderson, NV (US); Nathan J. Wadds, Las Vegas, NV (US); Oliver M. Schubert, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/962,827

(22) Filed: Aug. 8, 2013

(65) Prior Publication Data

US 2014/0103606 A1 Apr. 17, 2014

Related U.S. Application Data

(63) Continuation of application No. 12/321,318, filed on Jan. 16, 2009, now Pat. No. 8,511,684, and a continuation-in-part of application No. 12/291,909, filed on Nov. 14, 2008, now Pat. No. 8,490,973, and a (Continued)

(51) Int. Cl.
*A63F 1/12* (2006.01)
*A63F 1/14* (2006.01)

(Continued)

(52) U.S. Cl.
CPC ..... *A63F 1/14* (2013.01); *G07F 17/3293* (2013.01); *A63F 2009/2419* (2013.01); *A63F 2009/2457* (2013.01)

(58) Field of Classification Search
USPC ..... 273/139
See application file for complete search history.

(56) References Cited

U.S. PATENT DOCUMENTS

| | | | |
|---|---|---|---|
| 793,489 | A | 6/1905 | Williams |
| 1,014,219 | A | 1/1912 | Hall |

(Continued)

FOREIGN PATENT DOCUMENTS

| | | |
|---|---|---|
| EP | 1814091 | 8/2007 |
| GB | 2 395 138 | 5/2004 |

(Continued)

OTHER PUBLICATIONS

Brochure from TCS/John Huxley for Touch Table MultiPLAY™ Roulette, prior to 2007, 2 pages.

(Continued)

*Primary Examiner* — Tramar Harper
(74) *Attorney, Agent, or Firm* — TraskBritt

(57) ABSTRACT

Methods and apparatus for identifying unexpected cards in a card-handling device are disclosed. The method comprises providing a card-handling device, wherein the card-handling device comprises a card storage area, an output end for the manual removal of cards, a processor with associated memory, and a card recognition system capable of reading at least a rank of a card, wherein the associated memory has a data file of a set of expected card values, reading a value of a card, comparing the read card value to the set of expected card values, and when the card value is not an expected card value, generating an error signal indicative of a card not belonging to the set.

20 Claims, 10 Drawing Sheets

Related U.S. Application Data continuation-in-part of application No. 12/287,979, filed on Oct. 14, 2008, now abandoned, and a continuation of application No. 10/958,209, filed on Oct. 4, 2004, now Pat. No. 7,434,805.

(51) Int. Cl.
*G07F 17/32* (2006.01)
*A63F 9/24* (2006.01)

(56) References Cited

U.S. PATENT DOCUMENTS 1,831,580 A 11/1931 Stecker
1,885,276 A 11/1932 McKay
2,001,220 A 5/1935 Smith
2,001,918 A 5/1935 Nevius
2,016,030 A 10/1935 Woodruff et al.
2,023,210 A 12/1935 Potter
2,043,343 A 6/1936 Warner
2,065,824 A 12/1936 Plass
2,254,484 A 9/1941 Hutchins
2,328,153 A 8/1943 Laing
2,328,879 A 9/1943 Isaacson
2,364,413 A 12/1944 Wittel
2,395,138 A 2/1946 Nicholls
2,666,645 A 1/1954 Phillips
2,778,644 A 1/1957 Stephenson
2,937,739 A 5/1960 Levy
2,950,005 A 8/1960 MacDonald
3,147,978 A 9/1964 Sjostrand
3,222,071 A 12/1965 Lang
3,235,741 A 2/1966 Plaisance
3,312,473 A 4/1967 Friedman et al.
3,530,968 A 9/1970 Palmer
3,595,388 A 7/1971 Castaldi
3,690,670 A 9/1972 Cassady et al.
3,716,238 A 2/1973 Porter
3,735,982 A 5/1973 Gerfin
3,810,627 A 5/1974 Levy
3,876,208 A 4/1975 Wachtler et al.
3,897,954 A 8/1975 Erickson et al.
3,909,002 A 9/1975 Levy et al.
3,929,339 A 12/1975 Mattioli et al.
3,944,230 A 3/1976 Fineman
4,159,581 A 7/1979 Lichtenberg
4,171,737 A 10/1979 McLaughlin
4,232,861 A 11/1980 Maul
4,310,160 A 1/1982 Willette
4,339,798 A 7/1982 Hedges et al.
4,361,393 A 11/1982 Noto
4,368,972 A 1/1983 Naramore
4,384,044 A 5/1983 Kim et al.
4,385,827 A 5/1983 Naramore
4,388,994 A 6/1983 Suda et al.
4,397,469 A 8/1983 Carter
4,457,512 A 7/1984 Stevenson
4,467,424 A 8/1984 Hedges et al.
4,494,197 A 1/1985 Troy et al.
4,497,488 A 2/1985 Plevyak et al.
4,512,580 A 4/1985 Matviak
4,513,969 A 4/1985 Samsel
4,515,367 A 5/1985 Howard
4,531,187 A 7/1985 Uhland et al.
4,534,562 A 8/1985 Cuff et al.
4,566,782 A 1/1986 Britt et al.
4,586,712 A 5/1986 Lorber et al.
4,614,342 A 9/1986 Takashima
4,659,082 A 4/1987 Greenberg
4,662,637 A 5/1987 Pfeiffer et al.
4,667,959 A 5/1987 Pfeiffer et al.
4,711,371 A 12/1987 Harrigan
4,741,524 A 5/1988 Bromage
4,743,022 A 5/1988 Wood
4,750,743 A 6/1988 Nicoletti
4,755,941 A 7/1988 Bacchi
4,759,448 A 7/1988 Kawabata
4,760,527 A 7/1988 Sidley
4,770,421 A 9/1988 Hoffman
4,805,907 A 2/1989 Hagiwara
4,807,884 A 2/1989 Breeding
4,813,675 A 3/1989 Greenwood et al.
4,822,050 A 4/1989 Normand et al.
4,830,375 A 5/1989 Fleming
4,832,342 A 5/1989 Plevyak
4,876,000 A 10/1989 Mikhail
4,900,009 A 2/1990 Kitahara et al.
4,926,327 A 5/1990 Sidley
4,948,134 A 8/1990 Suttle et al.
4,951,950 A 8/1990 Normand et al.
4,969,648 A 11/1990 Hollinger et al.
4,995,615 A 2/1991 Cheng et al.
5,000,453 A 3/1991 Stevens et al.
5,022,653 A 6/1991 Suttle et al.
5,033,744 A 7/1991 Bridgeman et al.
5,067,713 A 11/1991 Soules et al.
5,081,487 A 1/1992 Hoyer et al.
5,121,192 A 6/1992 Kazui
5,121,921 A 6/1992 Friedman
5,179,517 A 1/1993 Sarbin et al.
5,199,710 A 4/1993 Lamle
5,209,476 A 5/1993 Eiba et al.
5,224,706 A 7/1993 Bridgeman et al.
5,224,712 A 7/1993 Laughlin et al.
5,240,140 A 8/1993 Huen
5,257,179 A 10/1993 DeMar et al.
5,261,667 A 11/1993 Breeding
5,265,882 A 11/1993 Malek et al.
5,275,411 A 1/1994 Breeding
5,276,312 A 1/1994 McCarthy et al.
5,277,424 A 1/1994 Wilms
5,283,422 A 2/1994 Storch et al.
5,288,081 A 2/1994 Breeding et al.
5,299,089 A 3/1994 Lwee et al.
5,299,803 A 4/1994 Halaby
5,303,921 A 4/1994 Breeding
5,308,065 A 5/1994 Bridgeman et al.
5,326,104 A 7/1994 Pease et al.
5,328,189 A 7/1994 Malek
5,356,140 A 10/1994 Dabrowski et al.
5,356,145 A 10/1994 Verschoor
5,362,053 A 11/1994 Miller et al.
5,374,061 A 12/1994 Albrecht et al.
5,382,024 A 1/1995 Blaha
5,382,025 A 1/1995 Sklansky et al.
5,390,910 A 2/1995 Mandel et al.
5,395,120 A 3/1995 Malek et al.
5,411,257 A 5/1995 Fulton et al.
5,411,270 A 5/1995 Naka et al.
5,431,399 A 7/1995 Kelley et al.
5,437,451 A 8/1995 Fulton et al.
5,437,462 A 8/1995 Breeding et al.
5,470,079 A 11/1995 LeStrange et al.
5,524,888 A 6/1996 Heidel
5,584,483 A 12/1996 Sines et al.
5,586,766 A 12/1996 Forte et al.
5,586,936 A 12/1996 Bennett et al.
5,586,937 A 12/1996 Menashe
5,591,081 A 1/1997 Suzuki
5,605,334 A 2/1997 McCrea et al.
5,613,912 A 3/1997 Slater et al.
5,651,548 A 7/1997 French et al.
5,655,961 A 8/1997 Acres et al.
5,669,816 A 9/1997 Garczynski et al.
5,669,817 A 9/1997 Tarantino et al.
5,676,372 A 10/1997 Sines et al.
5,681,039 A 10/1997 Miller et al.
5,683,085 A 11/1997 Johnson et al.
5,688,174 A 11/1997 Kennedy et al.
5,690,324 A 11/1997 Otomo et al.
5,692,748 A 12/1997 Frisco et al.
5,695,189 A 12/1997 Breeding et al.
5,707,287 A 1/1998 McCrea et al.
5,718,427 A 2/1998 Cranford et al.

(56) References Cited

U.S. PATENT DOCUMENTS 5,722,893 A 3/1998 Hill et al.
5,735,525 A 4/1998 McCrea et al.
5,735,742 A 4/1998 French et al.
5,739,925 A 4/1998 Kameyama et al.
5,769,417 A 6/1998 Richer et al.
5,770,533 A 6/1998 Franchi et al.
5,772,505 A 6/1998 Garczynski et al.
5,779,546 A 7/1998 Meissner et al.
5,781,647 A 7/1998 Fishbine et al.
5,788,574 A 8/1998 Ornstein et al.
5,803,808 A 9/1998 Strisower
5,803,809 A 9/1998 Yoseloff
5,823,879 A 10/1998 Goldberg et al.
5,836,775 A 11/1998 Hiyama et al.
5,863,041 A 1/1999 Boylan et al.
5,863,042 A 1/1999 Lo et al.
5,911,626 A 6/1999 McCrea et al.
5,919,090 A 7/1999 Mothwurf
5,934,998 A 8/1999 Forte et al.
5,936,222 A 8/1999 Korsunsky et al.
5,941,769 A 8/1999 Order
5,944,310 A 8/1999 Johnson et al.
D414,527 S 9/1999 Tedham
5,975,528 A 11/1999 Halaby
5,985,305 A 11/1999 Peery et al.
5,989,122 A 11/1999 Roblejo et al.
6,004,205 A 12/1999 Lauretta et al.
6,015,311 A 1/2000 Benjamin et al.
6,019,368 A 2/2000 Sines et al.
6,039,650 A 3/2000 Hill et al.
6,068,258 A 5/2000 Breeding et al.
6,069,564 A 5/2000 Hatano et al.
6,071,190 A 6/2000 Weiss et al.
6,074,420 A 6/2000 Eaton
6,093,103 A 7/2000 McCrea et al.
6,117,012 A 9/2000 McCrea et al.
6,126,166 A 10/2000 Lorson et al.
6,127,447 A 10/2000 Mitry et al.
6,139,014 A 10/2000 Breeding et al.
6,149,154 A 11/2000 Grauzer et al.
6,154,131 A 11/2000 Jones et al.
6,165,069 A 12/2000 Sines et al.
6,165,072 A 12/2000 Davis et al.
6,196,547 B1 3/2001 Pascal et al.
6,213,310 B1 4/2001 Wennersten et al.
6,217,447 B1 4/2001 Lofink et al.
6,236,223 B1 5/2001 Brady et al.
6,250,632 B1 6/2001 Albrecht
6,254,096 B1 7/2001 Grauzer et al.
6,254,484 B1 7/2001 McCrea, Jr.
6,267,248 B1 7/2001 Johnson et al.
6,267,648 B1 7/2001 Katayama et al.
6,267,671 B1 7/2001 Hogan
6,270,404 B2 8/2001 Sines et al.
6,293,864 B1 9/2001 Romero
6,299,167 B1 10/2001 Sines et al.
6,299,536 B1 10/2001 Hill
6,313,871 B1 11/2001 Schubert
6,319,122 B1 11/2001 Packes, Jr. et al.
6,325,373 B1 12/2001 Breeding et al.
6,342,830 B1 1/2002 Want et al.
6,343,989 B1 2/2002 Wood et al.
6,346,044 B1 2/2002 McCrea, Jr.
6,361,044 B1 3/2002 Block et al.
6,386,973 B1 5/2002 Yoseloff
6,403,908 B2 6/2002 Stardust et al.
6,435,970 B1 8/2002 Baerlocher et al.
6,443,839 B2 9/2002 Stockdale
6,446,864 B1 9/2002 Kim et al.
6,460,848 B1 10/2002 Soltys et al.
6,474,646 B1 11/2002 Webb
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,561,897 B1 5/2003 Bourbour et al.
6,565,432 B2 5/2003 Moody
6,568,678 B2 5/2003 Breeding et al.
6,575,831 B1 6/2003 Gonen et al.
6,579,180 B2 6/2003 Soltys et al.
6,579,181 B2 6/2003 Soltys et al.
6,582,230 B1 6/2003 Aoshima et al.
6,582,301 B2 6/2003 Hill
6,582,302 B2 6/2003 Romero
6,585,586 B1 7/2003 Romero
6,588,750 B1 7/2003 Grauzer et al.
6,588,751 B1 7/2003 Grauzer et al.
6,595,857 B2 7/2003 Soltys et al.
6,616,535 B1 9/2003 Nishizaki et al.
6,622,185 B1 9/2003 Johnson
6,626,757 B2 9/2003 Oliveras
6,629,889 B2 10/2003 Mothwurf
6,629,894 B1 10/2003 Purton
6,637,622 B1 10/2003 Robinson
6,638,161 B2 10/2003 Soltys et al.
6,645,068 B1 11/2003 Kelly et al.
6,645,077 B2 11/2003 Rowe
6,651,981 B2 11/2003 Grauzer et al.
6,651,982 B2 11/2003 Grauzer et al.
6,651,985 B2 11/2003 Sines et al.
6,652,379 B2 11/2003 Soltys et al.
6,655,684 B2 12/2003 Grauzer et al.
6,659,460 B2 12/2003 Blaha et al.
6,659,866 B2 12/2003 Frost et al.
6,663,490 B2 12/2003 Soltys et al.
6,666,765 B2 12/2003 Vancura
6,666,768 B1 12/2003 Akers
6,676,127 B2 1/2004 Johnson et al.
6,676,517 B2 1/2004 Beavers
6,680,843 B2 1/2004 Farrow et al.
6,685,567 B2 2/2004 Cockerille et al.
6,685,568 B2 2/2004 Soltys et al.
6,688,597 B2 2/2004 Jones
6,688,979 B2 2/2004 Soltys et al.
6,698,756 B1 3/2004 Baker et al.
6,712,696 B2 3/2004 Soltys et al.
6,712,698 B2 3/2004 Paulsen et al.
6,719,634 B2 4/2004 Mishina et al.
6,722,974 B2 4/2004 Sines et al.
6,726,205 B1 4/2004 Purton
6,732,067 B1 5/2004 Powderly
6,743,094 B2 6/2004 Johnson
6,746,333 B1 6/2004 Onda et al.
6,758,751 B2 7/2004 Soltys et al.
6,758,757 B2 7/2004 Luciano, Jr. et al.
6,774,782 B2 8/2004 Runyon et al.
6,804,763 B1 10/2004 Stockdale et al.
6,834,251 B1 12/2004 Fletcher
6,835,133 B2 12/2004 Baerlocher et al.
6,848,616 B2 2/2005 Tsirline et al.
6,848,844 B2 2/2005 McCue, Jr. et al.
6,848,994 B1 2/2005 Knust et al.
6,857,961 B2 2/2005 Soltys et al.
6,886,829 B2 5/2005 Hessing et al.
6,889,979 B2 5/2005 Blaha
6,896,620 B1 5/2005 Luciano et al.
6,921,337 B1 7/2005 Kennedy et al.
6,939,224 B2 9/2005 Palmer et al.
6,957,746 B2 10/2005 Martin et al.
6,959,925 B1 11/2005 Baker et al.
6,959,935 B2 11/2005 Buhl et al.
6,964,612 B2 11/2005 Soltys et al.
7,008,324 B1 3/2006 Johnson et al.
7,011,309 B2 3/2006 Soltys et al.
7,029,009 B2 4/2006 Grauzer et al.
7,036,818 B2 5/2006 Grauzer et al.
7,048,629 B2 5/2006 Sines et al.
7,059,602 B2 6/2006 Grauzer et al.
7,066,464 B2 6/2006 Blad et al.

(56) References Cited

U.S. PATENT DOCUMENTS

| | | | |
|---|---|---|---|
| 7,073,791 | B2 | 7/2006 | Grauzer et al. |
| 7,084,769 | B2 | 8/2006 | Bauer et al. |
| 7,106,201 | B2 | 9/2006 | Tuttle |
| 7,113,094 | B2 | 9/2006 | Garber et al. |
| 7,114,718 | B2 | 10/2006 | Grauzer et al. |
| 7,124,947 | B2 | 10/2006 | Storch |
| 7,139,108 | B2 | 11/2006 | Andersen et al. |
| 7,195,244 | B1 | 3/2007 | Feola |
| 7,198,569 | B2 | 4/2007 | Wolf et al. |
| 7,201,655 | B2 | 4/2007 | Walker et al. |
| 7,201,661 | B2 | 4/2007 | Kennedy et al. |
| 7,213,812 | B2 | 5/2007 | Schubert et al. |
| 7,217,187 | B2 | 5/2007 | Vancura |
| 7,237,969 | B2 | 7/2007 | Bartman |
| 7,255,344 | B2 | 8/2007 | Grauzer et al. |
| 7,255,351 | B2 | 8/2007 | Yoseloff et al. |
| 7,255,642 | B2 | 8/2007 | Sines et al. |
| 7,264,241 | B2 | 9/2007 | Schubert et al. |
| 7,278,917 | B2 | 10/2007 | McGlone et al. |
| 7,316,615 | B2 | 1/2008 | Soltys et al. |
| 7,322,576 | B2 | 1/2008 | Grauzer et al. |
| 7,325,806 | B1 | 2/2008 | Feola |
| 7,338,044 | B2 | 3/2008 | Grauzer et al. |
| 7,351,147 | B2 | 4/2008 | Stockdale et al. |
| 7,361,086 | B2 | 4/2008 | Gazdic et al. |
| 7,367,561 | B2 | 5/2008 | Blaha et al. |
| 7,367,563 | B2 | 5/2008 | Yoseloff et al. |
| 7,369,161 | B2 | 5/2008 | Easwar et al. |
| 7,374,170 | B2 | 5/2008 | Grauzer et al. |
| 7,384,044 | B2 | 6/2008 | Grauzer et al. |
| 7,407,438 | B2 | 8/2008 | Schubert et al. |
| 7,413,191 | B2 | 8/2008 | Grauzer et al. |
| 7,434,805 | B2 | 10/2008 | Grauzer et al. |
| 7,448,626 | B2 | 11/2008 | Fleckenstein |
| 7,451,987 | B1 | 11/2008 | Feola |
| 7,481,434 | B1 | 1/2009 | Feola |
| 7,510,186 | B2 | 3/2009 | Fleckenstein |
| 7,523,935 | B2 | 4/2009 | Grauzer et al. |
| 7,559,839 | B2 | 7/2009 | Bahar |
| 7,573,938 | B2 | 8/2009 | Boyce et al. |
| 7,593,544 | B2 | 9/2009 | Downs, III et al. |
| 7,661,676 | B2 | 2/2010 | Smith et al. |
| 7,677,565 | B2 | 3/2010 | Grauzer et al. |
| 7,699,694 | B2 | 4/2010 | Hill |
| 7,740,244 | B2 | 6/2010 | Ho |
| 7,753,373 | B2 | 7/2010 | Grauzer et al. |
| 7,753,798 | B2 | 7/2010 | Soltys et al. |
| 7,766,332 | B2 | 8/2010 | Grauzer et al. |
| 7,775,887 | B2 | 8/2010 | Kuhn et al. |
| 7,803,051 | B2 | 9/2010 | Kuhn et al. |
| 7,867,080 | B2 | 1/2011 | Nicely et al. |
| 7,878,892 | B2 | 2/2011 | Sines et al. |
| 7,901,285 | B2 | 3/2011 | Tran et al. |
| 7,933,448 | B2 | 4/2011 | Downs, III |
| 7,946,586 | B2 | 5/2011 | Krenn et al. |
| 8,016,659 | B2 | 9/2011 | Kuhn et al. |
| 8,070,574 | B2 | 12/2011 | Grauzer et al. |
| 8,141,875 | B2 | 3/2012 | Grauzer et al. |
| 8,170,232 | B2 | 5/2012 | Kitahara et al. |
| 8,262,475 | B2 | 9/2012 | Snow et al. |
| 2001/0000118 | A1 | 4/2001 | Sines et al. |
| 2001/0036231 | A1 | 11/2001 | Easwar et al. |
| 2001/0036866 | A1 | 11/2001 | Stockdale et al. |
| 2002/0002072 | A1 | 1/2002 | Sines et al. |
| 2002/0022510 | A1 | 2/2002 | Baerlocher et al. |
| 2002/0049909 | A1 | 4/2002 | Jackson et al. |
| 2002/0068635 | A1 | 6/2002 | Hill |
| 2002/0077170 | A1 | 6/2002 | Johnson et al. |
| 2002/0107067 | A1 | 8/2002 | McGlone et al. |
| 2002/0113368 | A1 | 8/2002 | Hessing et al. |
| 2002/0142820 | A1 | 10/2002 | Bartlett |
| 2002/0147042 | A1 | 10/2002 | Vuong et al. |
| 2002/0163125 | A1 | 11/2002 | Grauzer et al. |
| 2002/0187830 | A1 | 12/2002 | Stockdale et al. |
| 2003/0003997 | A1 | 1/2003 | Vuong et al. |
| 2003/0052450 | A1 | 3/2003 | Grauzer et al. |
| 2003/0054868 | A1 | 3/2003 | Paulsen et al. |
| 2003/0064798 | A1 | 4/2003 | Grauzer et al. |
| 2003/0084439 | A1 | 5/2003 | Perkins et al. |
| 2003/0087694 | A1 | 5/2003 | Storch |
| 2003/0090059 | A1 | 5/2003 | Grauzer et al. |
| 2003/0094756 | A1 | 5/2003 | Grauzer et al. |
| 2003/0151194 | A1 | 8/2003 | Hessing et al. |
| 2003/0195025 | A1 | 10/2003 | Hill |
| 2004/0003395 | A1 | 1/2004 | Srinivas et al. |
| 2004/0049909 | A1 | 3/2004 | Salot et al. |
| 2004/0067789 | A1 | 4/2004 | Grauzer et al. |
| 2004/0100026 | A1 | 5/2004 | Haggard |
| 2004/0116179 | A1 | 6/2004 | Nicely et al. |
| 2004/0152502 | A1 | 8/2004 | Okada |
| 2004/0185933 | A1 | 9/2004 | Nicely |
| 2004/0224777 | A1 | 11/2004 | Smith et al. |
| 2004/0229682 | A1 | 11/2004 | Gelinotte |
| 2004/0256803 | A1 | 12/2004 | Ko |
| 2005/0012270 | A1 | 1/2005 | Schubert et al. |
| 2005/0026680 | A1 | 2/2005 | Gururajan |
| 2005/0035548 | A1 | 2/2005 | Yoseloff et al. |
| 2005/0037843 | A1 | 2/2005 | Wells et al. |
| 2005/0051955 | A1 | 3/2005 | Schubert et al. |
| 2005/0051956 | A1 | 3/2005 | Grauzer et al. |
| 2005/0051965 | A1 | 3/2005 | Gururajan |
| 2005/0062226 | A1 | 3/2005 | Schubert et al. |
| 2005/0062227 | A1 | 3/2005 | Grauzer et al. |
| 2005/0082750 | A1 | 4/2005 | Grauzer et al. |
| 2005/0104289 | A1 | 5/2005 | Grauzer et al. |
| 2005/0104290 | A1 | 5/2005 | Grauzer et al. |
| 2005/0113166 | A1 | 5/2005 | Grauzer et al. |
| 2005/0137005 | A1 | 6/2005 | Soltys et al. |
| 2005/0146093 | A1 | 7/2005 | Grauzer et al. |
| 2005/0164759 | A1 | 7/2005 | Smith et al. |
| 2005/0206077 | A1 | 9/2005 | Grauzer et al. |
| 2005/0242500 | A1 | 11/2005 | Downs |
| 2005/0272501 | A1 | 12/2005 | Tran et al. |
| 2006/0025213 | A1 | 2/2006 | Kane et al. |
| 2006/0030400 | A1 | 2/2006 | Mathis |
| 2006/0033269 | A1 | 2/2006 | Grauzer et al. |
| 2006/0033270 | A1 | 2/2006 | Grauzer et al. |
| 2006/0046853 | A1 | 3/2006 | Black |
| 2006/0063577 | A1 | 3/2006 | Downs et al. |
| 2006/0084505 | A1 | 4/2006 | Yoseloff et al. |
| 2006/0131809 | A1 | 6/2006 | Lancaster et al. |
| 2006/0181022 | A1 | 8/2006 | Grauzer et al. |
| 2006/0199649 | A1 | 9/2006 | Soltys et al. |
| 2006/0217188 | A1 | 9/2006 | Walker et al. |
| 2006/0226604 | A1 | 10/2006 | Saucier |
| 2006/0234796 | A1 | 10/2006 | Nobrega et al. |
| 2006/0252521 | A1 | 11/2006 | Gururajan et al. |
| 2006/0252554 | A1 | 11/2006 | Gururajan et al. |
| 2006/0279040 | A1 | 12/2006 | Downs et al. |
| 2006/0281537 | A1 | 12/2006 | Abbott et al. |
| 2007/0006708 | A1 | 1/2007 | Laakso |
| 2007/0018389 | A1 | 1/2007 | Downs |
| 2007/0069462 | A1 | 3/2007 | Downs et al. |
| 2007/0072682 | A1 | 3/2007 | Crawford et al. |
| 2007/0102879 | A1 | 5/2007 | Stasson |
| 2007/0117604 | A1 | 5/2007 | Hill |
| 2007/0138743 | A1 | 6/2007 | Fleckenstein |
| 2007/0149280 | A1 | 6/2007 | LeMay et al. |
| 2007/0205559 | A1 | 9/2007 | Webb et al. |
| 2007/0210515 | A1 | 9/2007 | Schubert et al. |
| 2007/0222147 | A1 | 9/2007 | Blaha |
| 2007/0238504 | A1 | 10/2007 | Oliveras |
| 2007/0256111 | A1 | 11/2007 | Medford et al. |
| 2007/0259709 | A1 | 11/2007 | Kelly et al. |
| 2007/0275762 | A1 | 11/2007 | Aaltone et al. |
| 2008/0006996 | A1 | 1/2008 | Frankel et al. |
| 2008/0006997 | A1 | 1/2008 | Scheper et al. |
| 2008/0006998 | A1 | 1/2008 | Grauzer et al. |
| 2008/0018047 | A1 | 1/2008 | Schubert et al. |
| 2008/0037628 | A1 | 2/2008 | Boyce et al. |
| 2008/0051171 | A1 | 2/2008 | Lutnick et al. |
| 2008/0076500 | A1 | 3/2008 | Lancaster et al. |
| 2008/0076506 | A1 | 3/2008 | Nguyen et al. |
| 2008/0108426 | A1 | 5/2008 | Nguyen et al. |

(56) References Cited

U.S. PATENT DOCUMENTS

| | | | |
|---|---|---|---|
| 2008/0111300 | A1 | 5/2008 | Czyzewski et al. |
| 2008/0113700 | A1 | 5/2008 | Czyzewski et al. |
| 2008/0113764 | A1 | 5/2008 | Soltys |
| 2008/0113772 | A1 | 5/2008 | Burrill et al. |
| 2008/0113783 | A1 | 5/2008 | Czyzewski et al. |
| 2008/0119257 | A1 | 5/2008 | Stern et al. |
| 2008/0176617 | A1 | 7/2008 | Kekempanos et al. |
| 2008/0203658 | A1 | 8/2008 | Grauzer et al. |
| 2008/0258388 | A1 | 10/2008 | Schugar et al. |
| 2008/0268933 | A1 | 10/2008 | Sines et al. |
| 2008/0268939 | A1 | 10/2008 | Sines et al. |
| 2008/0268940 | A1 | 10/2008 | Sines et al. |
| 2008/0301672 | A1 | 12/2008 | Rao et al. |
| 2008/0303210 | A1 | 12/2008 | Grauzer et al. |
| 2009/0017888 | A1 | 1/2009 | Kuhn et al. |
| 2009/0054161 | A1 | 2/2009 | Schubert et al. |
| 2009/0069090 | A1 | 3/2009 | Moser et al. |
| 2009/0098932 | A1 | 4/2009 | Longway |
| 2009/0115133 | A1 | 5/2009 | Kelly et al. |
| 2009/0131151 | A1 | 5/2009 | Harris et al. |
| 2009/0140492 | A1 | 6/2009 | Yoseloff et al. |
| 2009/0191933 | A1 | 7/2009 | French |
| 2009/0224476 | A1 | 9/2009 | Grauzer et al. |
| 2009/0283969 | A1 | 11/2009 | Tseng |
| 2009/0286585 | A1 | 11/2009 | Walker |
| 2009/0289414 | A1 | 11/2009 | Bergman et al. |
| 2010/0038849 | A1 | 2/2010 | Scheper et al. |
| 2010/0062845 | A1 | 3/2010 | Wadds et al. |
| 2010/0244382 | A1 | 9/2010 | Snow |
| 2010/0276880 | A1 | 11/2010 | Grauzer et al. |
| 2010/0283202 | A1 | 11/2010 | Ho |
| 2010/0314830 | A1 | 12/2010 | Grauzer et al. |
| 2011/0018195 | A1 | 1/2011 | Downs, III et al. |
| 2011/0031686 | A1 | 2/2011 | Tseng |
| 2011/0109042 | A1 | 5/2011 | Rynda et al. |
| 2011/0198805 | A1 | 8/2011 | Downs, III et al. |
| 2011/0254222 | A1 | 10/2011 | Blaha et al. |
| 2012/0286471 | A1 | 11/2012 | Grauzer et al. |

FOREIGN PATENT DOCUMENTS

| | | |
|---|---|---|
| WO | 8700764 | 2/1987 |
| WO | 9840136 | 9/1998 |
| WO | 0051076 | 8/2000 |
| WO | 0230529 | 4/2002 |
| WO | 2004112923 | 12/2004 |
| WO | 2007067213 | 6/2007 |
| WO | 2007103351 | 9/2007 |
| WO | 2008028148 | 3/2008 |
| WO | 2008091809 | 7/2008 |
| WO | 2009025673 | 2/2009 |

OTHER PUBLICATIONS

Dragon Bacc, brochure, pub. Feb. 16, 2007 (2 pgs); retrieved Feb. 4, 2010 from DigiDeal Corporation Web site: http://www.digideal_com/products/dragonbacc.php.

Extended European Search Report for corresponding EPO Application No. 10177548.4 dated Jan. 21, 2011; 8 pages.

Google search for card handling device with storage area, card removing system pivoting arm and processor . . . , http://www.google.com/?tbm=pts&hl=en; Jul. 28, 2012.

http://www.google.com/search?tbm=pts &q=Card+handling+devicve+with+input+and+outpu . . . Jun. 8, 2012.

http://www.google.com/search?tbm=pts &q=shuffling+zone+on+Oopposite+side+of+input+. . . Jul. 18, 2012.

International Search Report and the Written Opinion of the International Searching Authority for PCT Application No. PCT/US2009/053606; Dec. 3, 2009; 12 pages.

International Search Report and Written Opinion, mailed Sep. 1, 2009, for PCT Application No. PCT/US2009/050562, filed Jul. 14, 2009.

International Search Report and Written Opinion of the International Searching Authority for PCT Application No. PCT/US2009/062993; Jan. 11, 2010; 11 pages.

International Search Report for PCT/US07/22894, dated Jun. 11, 2008, 1 page.

Nevada State Certificate of Registration for Trademark SAFEJACK to Mikohn Gaming Corporation of Las Vegas, Nevada dated Sep. 4, 1997.

PCT International Search Report and Written Opinion of the International Searching Authority for PCT/US2009/062855, dated Feb. 26, 2010, 15 pages.

PCT International Search Report for PCT/US07/15036 dated Sep. 23, 2008, 3 pages.

Press Release for Alliance Gaming Corp., Jul. 26, 2004—Alliance Gaming Announces Contract With Galaxy Macau for New MindPlay Baccarat Table Technology, http://biz.yahoo.com/prnews.

Scarne's Encyclopedia of Games by John Scarne, 1973, "Super Contract Bridge", p. 153.

Service Manual/User Manual for Single Deck Shufflers: BG1, BG2 and BG3 by Shuffle Master © 1996.

Specification of Australian Patent Application No. 31577/95, filed Jan. 17, 1995, Applicants: Rodney G. Johnson et al., Title: Card Handling Apparatus.

Specification of Australian Patent Application No. Not Listed, filed Aug. 15, 1994, Applicants: Rodney G. Johnson et al., Title: Card Handling Apparatus.

Three (3) pictures taken of an Accuplay Table from TCS/John Huxley in use in an Arcade in Buylgaria, Feb. 2008.

Tracking the Tables, by Jack Bularsky, Casino Journal, May 2004, vol. 17, No. 5, pp. 44-47.

Example
Display Layout

59

| P | T | B | Display Player's hand, Banker's hand and the winning hand. |
|---|---|---|---|
| 40% | 20% | 40% | |
| X | | X | 7♥J♠ 7 |
| | X | | 3♦4♣2♠9♣ 8 WINNER |
| X | | | |
| | | X | |
| X | | | |
| | | X | |
| | | X | |
| X | | | |
| | X | | |

Ticker Scroll for advertising

Fig. 2

CARD-READING SHOE WITH INVENTORY CORRECTION FEATURE AND METHODS OF CORRECTING INVENTORY

CROSS-REFERENCE TO RELATED APPLICATIONS

This application is a continuation of U.S. patent application Ser. No. 12/321,318 filed Jan. 16, 2009, now U.S. Pat. No. 8,511,684, issued Aug. 20, 2013, which is a continuation-in-part of U.S. patent application Ser. No. 12/291,909, filed Nov. 14, 2008; now U.S. Pat. No. 8,490,973, issued Jul. 23, 2013, which is a continuation-in-part of U.S. patent application Ser. No. 12/287,979, filed Oct. 14, 2008, now abandoned; which is a continuation of U.S. patent application Ser. No. 10/958,209, filed Oct. 4, 2004, now U.S. Pat. No. 7,434,805, issued Oct. 14, 2008. This application is also related to U.S. patent application Ser. No. 12/218,583, filed Jul. 15, 2008, now U.S. Pat. No. 8,262,475, issued Sep. 11, 2012; U.S. patent application Ser. No. 12/228,713, filed Aug. 15, 2008; U.S. patent application Ser. No. 11/558,810, filed Nov. 10, 2006, now abandoned; U.S. patent application Ser. No. 11/598,259, filed Nov. 9, 2006, now U.S. Pat. No. 7,766,332, issued Aug. 3, 2010; and U.S. patent application Ser. No. 12/290,946, filed Nov. 4, 2008, now U.S. Pat. No. 7,946,586, issued May 24, 2011. The disclosures of all of the above-identified applications are incorporated herein by this reference in their entirety.

TECHNICAL FIELD

The present invention relates to the field of gaming, particularly methods and apparatus for delivering cards to casino table games.

BACKGROUND

Cards are ordinarily provided to players in casino table card games directly from a deck held in the dealer's hands, from a dealing shoe or from a shuffler. The original dealing shoes were little more than trays that supported the deck(s) of cards and allowed the dealer to remove the front card (with its front facing the table to hide the rank of the card) and deliver it to a player. Over the years, both stylistic and functional changes have been made to dealing shoes, which have been used for blackjack, poker, baccarat and other casino table card games.

Newer gaming systems enable play of live table games with electronic wagering interfaces. For purposes of this disclosure, a "semi-automatic gaming system" is a system that enables play of a live game of chance using physical game pieces such as cards, dice and other structures capable of randomly determining game outcome. Such systems include a physical game play surface, a game controller and multiple electronic player interfaces that enable at least credit wagering and preferably the input of game play decisions. The game controller is capable of determining game outcomes. These gaming systems can include a card delivery shoe or a shuffler with card-reading capability.

U.S. Pat. No. 5,779,546 to Meissner et al. describes a method and apparatus for monitoring live card games. An automated dealing shoe dispenses each of the cards and recognizes each of the cards as each of the cards is dispensed. Player stations are also included. Each player station enables a player to enter a bet, request that a card be dispensed or not dispensed, and to convert each bet into a win or a loss based upon the cards that are dispensed by the automated dealing shoe.

U.S. Pat. No. 6,117,012 to McCrea, Jr., discloses a secure game table system for monitoring each hand in a progressive live card game. The secure game table system comprises: a gaming table surface, a shoe for holding cards, the shoe having a card reader, the card reader issuing a signal corresponding at least to the value and suit for each card. The system includes a game bet sensor located near each of a plurality of player positions for sensing the presence of a game bet, when the presence of the game bet is sensed, the game bet sensor issues a signal corresponding to that presence. A plurality of card sensors is located near each of the plurality of player positions and a dealer position, the card sensor issuing a signal when a card in a hand is received at a card sensor of the plurality of card sensors. The system also includes a game controller, the game controller capable of issuing a signal when a card is delivered to the wrong position on the table.

U.S. Pat. No. 6,582,301 to Hill describes a dealing shoe that has a card scanner that scans indicia on a playing card as the card moves along and out of a chute by manual direction by the dealer in the normal fashion.

Systems of the Hill Patent record the rank and suit of scanned cards being removed from the shoe. Discrepancies between the read cards and actual cards dispensed can be manually identified. A record of the number and value of cards remaining in the shoe is also maintained. The shoe of Hill has a user input that allows the user to input a "burn" command to burn (i.e., discard) cards prior to dealing.

Each of the references identified in the Background and the remainder of the specification, including the Cross-Reference to Related Applications section, is incorporated herein by reference in their entirety as part of the enabling disclosure for such elements as apparatus, methods, hardware and software.

BRIEF SUMMARY

Methods of detecting unexpected cards delivered from a shoe are described. One method identifies unexpected cards, the method comprising: providing a card-handling device, wherein the card-handling device comprises card storage area, an output end for the manual removal of cards, a processor with associated memory and a card recognition system capable of reading at least a rank of a card, wherein the associated memory has a data file of a set of expected card values; reading a value of a card; and comparing the read card value to the set of expected card values, and when the card value is not an expected card value, generating an error signal indicative of a card not belonging to the set. A preferred card-handling device is a shoe.

A device for detecting the presence of cards that are not a part of an expected set of cards is disclosed. The device includes: a card storage area; an output end configured for the manual removal of cards; a processor with associated memory; and a card recognition system capable of reading at least a rank of a card. The associated memory contains a stored data file of a set of expected card values. The processor is programmed to compare read card values to expected card values. When a card is recognized, the value of the card is compared to the set of expected card values and if the read card is not part of the expected card set, a signal indicative of a presence of an unexpected card value is generated.

The present invention includes, in some embodiments, a method of maintaining a running inventory of cards used in a card-handling device. The method comprises providing a set of expected card values in a group of cards inserted into a card-handling device. The card-handling device comprises a card-reading device, an associated processor and memory. The method includes storing the set of expected card values in memory, removing cards individually from the card-handling device and reading a card value of all cards removed from the card-handling device. The method also includes maintaining a running inventory of read card values of cards removed from the card-handling device in memory and comparing each read card value to the expected card values. When a read card value is not a part of the set of expected card values, a user is provided with an option to use a card, wherein the used card is added to the running inventory; an option to burn a card, wherein the card is added to the running inventory; and an option to remove a card, wherein the removed card is not added to the running inventory.

The present invention can also be characterized, in some embodiments, as a card-handling device enabling a user to select from a burn, a use or a remove option when an unexpected card is read. According to the invention, the card-handling device comprises an area for holding a group of cards, an output end for removal of cards, a card-reading system for identifying card value information, memory containing a set of expected card values and a processor programmed to compare each read card value to the set of expected card values in memory and to generate a signal indicating an unexpected card has been read. The invention also includes a user input to enable a user to select an instruction selected from the group consisting of burn, use and remove when an unexpected card value has been read.

Apparatuses of the present invention are capable of recovering from card-reading errors. According to the invention, a card-handling device comprises an area for holding a group of cards, an output end for removal of cards, a card-reading system for identifying card value information and memory containing a set of expected card values. The invention also includes a processor programmed to compare read card value information with expected card value information and generate a signal when a read card is not recognized by the card-reading system, and a user input to enable a user to manually input a card value corresponding to the card that was not recognized.

Apparatuses of the present invention are capable of burning one or more cards at any time, including before, during or after play, and at any point of deck penetration in the shoe. According to the invention, a card-handling device is provided comprising an area for holding a group of cards, an output end for removal of cards, a card-reading system for identifying card value information and a processor and associated memory, wherein the processor is programmed with game rules and to receive read card information from the card-reading system. According to the invention, a user input is provided that enables a user to burn at least one card at any time such that the burned card is disregarded in determining game outcome.

BRIEF DESCRIPTION OF THE DRAWINGS

FIG. 2 shows a representation of a screen shot from a common player display screen for baccarat.

DETAILED DESCRIPTION OF THE INVENTION

Figure 1:
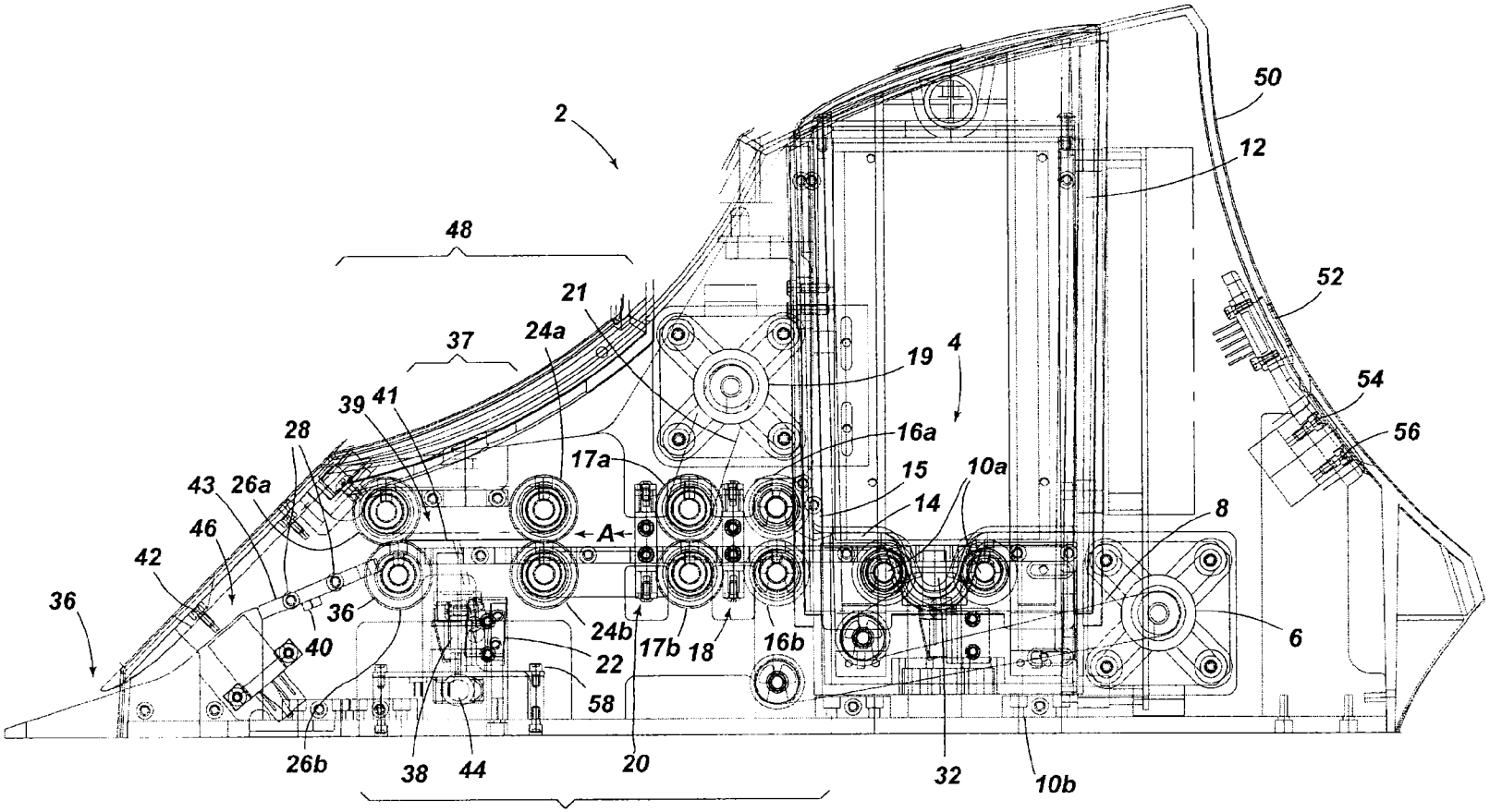
FIG. 1 is a side elevational view of a first embodiment of a card delivery shoe according to the invention.

Baccarat is just one example of the many live table games played in casinos or gaming establishments. Baccarat is a game that is suitable for play on a semi-automatic gaming system. Baccarat uses multiple standard decks of 52 playing cards and is usually dealt from a shoe (or continuous shuffler) having multiple decks that have been shuffled together prior to the beginning of play.

The object of the game of baccarat is for the bettor to successfully wager on whether the banker hand or the player hand is going to win, i.e., have a hand count, modulo ten, closest to the target count of nine. The bettor receives even money for his wager if he selects the winning hand and loses his wager if he selects the losing hand. Because of the rules of play of baccarat and, more particularly, the pre-established draw rules, the banker hand has a slightly higher chance of winning than does the player's hand. Therefore, if the bettor wagers on the banker hand and the banker hand wins, the bettor must pay to the gaming establishment a commission, typically 5% of the amount the bettor wins. No commission is paid if the bettor successfully wagers on the player hand. The standard rules of baccarat are well known in the art and need not be repeated in this disclosure.

An improved apparatus for delivering cards to a game of baccarat or other suitable "shoe game" is disclosed. Card-handling devices of the present invention may comprise card-reading shoes or card-reading continuous shufflers. An example of a suitable shuffler is disclosed in U.S. patent application Ser. No. 12/290,946, filed Nov. 4, 2008, now U.S. Pat. No. 7,946,586, issued May 24, 2011, the disclosure of which is hereby incorporated by reference herein.

Known card-dispensing devices are capable of reading cards and maintaining a running count of cards removed and cards remaining in the device, so long as there are no card-reading errors, no unexpected cards that are not recognized by the card-reading device and no extra cards removed. In other words, the known devices cannot compensate for deviations in normal play. Devices and methods of the present invention address the shortcomings of known devices.

One method of the present invention detects unexpected cards. Unexpected cards are cards having a value or values that do not belong to a group of cards. When the user loads a group of cards into a card-handling device, such as a shoe, those cards typically are identical to an expected set of cards. For example, in a shoe game that utilizes eight decks of cards, each shoe includes eight each of an ace, king, queen, jack, ten, nine, eight, seven, six, five, four, three, and two of each of spades, hearts, clubs and diamonds, respectively. Since each deck contains 52 cards, the total number of cards in the eight-deck-expected set is 416 cards, and there are eight each of 52 distinct cards.

A method for identifying unexpected cards in a card-handling device is disclosed. The method comprises providing a card-handling device, wherein the card-handling device comprises a card storage area, an output end for the manual removal of cards, a processor with associated memory, and a card recognition system capable of reading card value information, and preferably at least a rank of a card, wherein the associated memory has a data file containing a set of expected card values.

According to the invention, the method includes the step of reading a value of a card. Card values can be read in numerous ways. One exemplary way is by using a two-dimensional CMOS sensing array and processing the CMOS signals in an FPGA or ASIC circuit, as disclosed in U.S. patent application Ser. No. 11/484,011, filed Jul. 7, 2006, now U.S. Pat. No. 7,933,448, issued Apr. 26, 2011, the disclosure of which is incorporated herein by reference. The method also includes comparing the read card value to the set of expected card values, and when the card value is not an expected card value, generating an error signal indicative of a card not belonging to the set.

If a dealer draws a blank card or a joker, for example (and the game does not use jokers), the card image will be compared to the expected set and the processor will determine that the card is an unexpected card.

Preferably, an inventory of cards being removed from the card-handling device is also being maintained and read cards are also compared to the running inventory to determine when the quantity of a particular allowed type of card has been exceeded. For example, if a ninth ace of spaces is drawn from an eight-deck shoe, a comparison of the read card to the expected set will reveal that the card is part of the set, but a comparison with the running inventory will show that the card is not part of the expected set and an error signal will be generated. The error signal will indicate an extra card is present, but will not indicate which extra card in the running inventory of that rank and suit is the unexpected card.

When the game being played is baccarat, a preferred card-handling device is a shoe. When the game is blackjack, the card-handling device may be a shoe or a shuffler. Some casino operators prefer continuous shufflers over shoes because card counters cannot count cards from a continuous supply of cards.

Although the exemplary set of cards described above is eight decks of cards, other sets of cards, such as four-deck, five-deck, six-deck and seven-deck groups can be used, as well as special decks, such as the decks or multiple decks used to play the SPANISH 21® blackjack variant game where ten value cards are removed. The present invention also contemplates the use of modified decks, such as decks with one or more jokers present, other special cards, one or more extra suits, promotional cards, and the like. If a less conventional set of cards is used to play a game, the expected set data file must be modified to reflect the composition of the set of cards.

Examples of cards that can be sensed in a game utilizing standard cards and that would generate an error signal include, by way of non-limiting example, a blank card, a joker, an extra card, a specially marked card, a promotional card, a cut card, an inverted or upturned card (in which the card back is being read instead of the face), a bonus card and extra conventional cards.

Most card recognition systems require that the system is trained to recognize a particular brand or style of card. Occasionally, the system may fail to recognize a card because the system was trained on one type of card but the casino has changed to another type of card. Typically, most of the cards are accurately identified, but, on occasion, a card might not be recognizable. According to a preferred method, a card recognition error signal is generated in response to the card recognition system failing to read a card.

When a signal is generated, the user and/or pit manager can be alerted and, according to the method, the user may be provided with an opportunity to input the rank and/or suit information so that the running inventory record (i.e., read cards removed from the shoe) remains accurate.

Depending on the capacity of the processor and memory, it might be desirable to export the running inventory and/or expected inventory information to an external computer. According to the method, an input/output (I/O) port is provided on the card-handling device that enables the internal processor to communicate with at least one of an external processor, an external data storage device and a network. In this manner, a central database of all shoe histories can be maintained for data mining and analysis purposes.

When an error detection signal is generated, it is preferable that the method includes the step of allowing the user to elect a decision about how the card can be used. According to an aspect of the invention, when an error signal is generated, a user can elect to use the card in the game or burn the card.

If a rated player was playing baccarat and the system detected a ninth ace of spades dealt from an eight-deck shoe, the system would alert the dealer and/or a pit supervisor and the dealer and/or pit supervisor could then input a decision to burn the card or play the card. In one embodiment, the alert is silent and is transparent to the player. The casino might allow the dealer to use the card in play in order to keep a rated player happy, especially if there was no other evidence of suspicious activity. Extra cards might be evidence of cheating, but they can also be present due to handling errors in the card-shuffling facility, or due to packing errors at the card-manufacturing facility. On the other hand, a casino might have a strict policy that voids all hands from a shoe that is found to contain unexpected cards.

If the card that was read was accurately identified by the card-sensing system but is identified as an extra card, preferred methods provide the user with the opportunity to select the option of removing the card. In this instance, a user would input a "remove" command and that card would not be included in the running inventory data. Methods of the present invention may be practiced on an apparatus capable of generating a signal in response to the device sensing the presence of an unexpected card.

A card-handling device capable of detecting the presence of cards that are not a part of an expected set of cards is disclosed. The card-handling device in its broadest sense includes a card storage area, such as a rectangular container with a sloping lower surface for manually delivering individual cards into a card game. The card-handling device has an output end configured for the manual removal of cards. In one example, the output end has an inverted U-shaped opening for sliding cards individually downward and horizontally away from the device onto a gaming surface. The device includes a processor with associated memory and a card recognition system capable of reading card values, for example, at least a rank of a card. Although rank is the most relevant marking for the game of baccarat, other games include rules that make other types of card value markings important, such as suit. The present invention contemplates reading all types of known markings on cards.

According to the present invention, the associated memory has a data file of a set of expected card values, and the processor is programmed to compare read card values to expected card values. When a card is recognized, the value of the card is compared to the set of expected card values and if the read card is not part of the expected card set, a signal indicative of a presence of an unexpected card value is generated. In other embodiments, the read card value is also compared to the running inventory as an additional verification that the card belongs to the set. This extra comparison is useful for detecting the presence of too many cards of a rank/suit that are part of the expected set.

Devices of the present invention preferably comprise a user interface to input selections, including use/burn or use/burn/remove, when a signal indicative of an unexpected card is generated. Preferably, the device has a display with touch screen controls and the user can input the selection on the touch screen. It is preferable to include a "remove" option in addition to a "burn" option because this election removes the read card value from the running inventory. If the card is present in error, the accuracy of the running inventory is maintained by allowing the user the option to remove the data from the data file.

The device of the present invention may include a silent alarm, an audible alarm (with or without volume control), a visual indication of an unexpected card, and the like. Some casinos may wish to quietly alarm pit personnel that an unexpected card is present so they can determine whether or not to play the card without upsetting players. The casino might wish to alert security without alerting the players if cheating is suspected, giving security more time to take action. There are numerous reasons why providing a silent alarm option is desirable.

In some embodiments, the processor is programmed with game rules, and when the burn card option is selected, the burned card or cards are not considered in resolving the game according to the game rules. For example, a pit manager might instruct the dealer to burn a card rather than play it. The dealer inputs a burn command on the user interface and a signal is sent to the processor of the decision to burn the card. This card is removed from game play and is not considered by the processor in resolving the hands and determining game outcome. However, the burn card remains part of the running inventory.

Methods of the present invention maintain an accurate running inventory of cards being removed from a shoe, so that the data files can be later analyzed and mined for information, and compared to win/loss records at the table. Since many baccarat tables now provide electronic historical trend displays, it is advantageous and necessary for the trend information to match the actual game play. This can only be accomplished by keeping an accurate running inventory file. In order to maintain the accuracy of the data, the system must allow the dealer to compensate for card-reading errors (e.g., not recognizing a card, misreading the card, etc.) to compensate for cards read and drawn before they are needed in the play of the game, and to compensate for when two cards are pulled at one time but only one card is read.

The running inventory may be accurately maintained using a method of the present invention described below. A method of maintaining a running inventory of cards used in a card-handling device comprises the step of providing a set of expected card values in a group of cards inserted into a card-handling device. This expected set typically identifies each unique card in the set, as well as the number of repeats of each card per set. The method utilizes a card-handling device comprising a card-reading device with an associated processor and memory. According to the method, a set of expected card values is stored in memory. Cards are individually removed from the card-handling device so that they can be put into play. The values of all cards removed from the card-handling device are read. A running inventory of read card values of cards removed from the card-handling device is maintained in memory. According to the method, each read card value is compared to the expected card values, and when a read card value is not a part of the set of expected card values, a user is provided with an option to use a card, wherein the used card value is added to the running inventory; an option to burn a card, wherein the burn card value is added to the running inventory; and an option to remove a card, wherein the value of the removed card is not input and, therefore, not added to the running inventory.

An exemplary expected set of cards according to a preferred method contains between four and eight standard decks of 52 cards each. An exemplary card-handling device used to practice the method is a shoe. A preferable shoe is mechanized with card-reading capability internal to the device. A preferred shoe has an internal processor that receives card value information from the card-reading system and is programmed to determine game outcome. Cards that are burned or removed are not used in determining game outcome. Burned cards remain in the running inventory, while removed cards are not included in the running inventory data file.

According to one exemplary method, the card-reading system is preferably trained to detect cut cards, which may or may not be included in the expected inventory file. In the game of baccarat, the cut card is usually present near the end of the shoe, i.e., within ten cards of the end of the shoe. Once the cut card is sensed, the user display indicates the cut card has been reached and, according to the method, the user may elect to burn the remaining cards to complete the running inventory file. When the shoe is in the burn card mode, the dealer may remove all remaining cards, including the cut card, to complete the running inventory. At this point, the running inventory file is compared to the expected card value file to verify that the shoe is complete. If there are discrepancies, a signal that indicates an inequality is generated and an external processor or the shoe's internal processor sends a command to a display or a printer to generate a visual report of extra or missing cards. When the shoe has been verified, a visual indication of a complete shoe is preferably displayed. Alternatively, the shoe may be programmed to require the user to input a separate "burn" command for each card burned.

An apparatus that dispenses cards to a card game and that maintains an accurate running inventory of cards dealt is disclosed. The card-handling device of the present invention comprises an area for holding a group of cards. This area may be rectangular and have a declining lower surface for supporting a long edge of each card stored in the area. The device has an output end for removal of cards. Preferably, the output end is configured such that cards may be removed individually and manually. A card-reading system is provided for identifying card value information. The system includes memory containing a data file of a set of expected card values. This expected card value data set includes each card that was intended by the casino to be present, including all unique cards and the number of repeats of each unique card. Typically there are 52 unique cards per standard deck and each shoe holds between two and eight decks of cards, typically four to six decks, and preferably six decks.

According to the invention, a processor is programmed to compare each read card value to the set of expected card values in memory and to generate a signal indicating an unexpected card has been read. A user input is provided to enable a user to select an instruction selected from the group consisting of burn, use and remove when an unexpected card value has been read.

The processing and storage of data may be internal to the machine or external to the machine. In one embodiment, an I/O port is provided that enables the processor to communicate with at least one of an external processor, an external data storage device and a network. The memory may be internal to or external to the card-handling device. In a preferred embodiment, the card-handling device is a shoe and the memory is internal to the shoe. The running inventory and expected inventory files are contained in the internal memory.

In one embodiment, the card-handling device includes an external display either on an exterior surface or in information communication with the card-handling device. The processor causes the display to display multiple user options that are used in part to create an accurate running inventory record for the shoe.

A card-handling device with read card error correction capability is disclosed. According to the invention, a card-handling device is provided, comprising an area for holding a group of cards, an output end for removal of cards, a card-reading system for identifying card value information, memory containing a set of expected card values, a processor programmed to compare read card value information with expected card value information and generate a signal when a read card is not recognized by the card-reading system, and a user input to enable a user to manually input a card value corresponding to the card that was not recognized.

A preferred card-handling device is a shoe. The shoe may have card-moving rollers (mechanized) or may not have moving mechanical parts. The memory of the device preferably contains a running inventory of read card values, and when a card value is manually input, that card value is added to the running inventory.

It sometimes happens that two cards are simultaneously drawn but only one card is read. A dealer who sees this can input a command to add the missing card value to the running inventory. In one embodiment, when the game is baccarat, the dealer can recall the hand composition by inputting a hand recall command into the user interface. By comparing the actual cards drawn to displayed hand composition, the dealer can quickly identify which card was not read and input this card value to maintain a correct running inventory. The display may provide an option to show the hands face down in a default position and allow the dealer to flip over the virtual cards when needed.

There may be instances when the dealer does not wish to use the card that was drawn. In that case, the dealer has the option to input a command to discard the card, to use the card or to burn the card. The last two options result in the input card information being added to the running inventory record. The user input in one example of the invention is configured to allow the dealer to choose a burn, play or discard option.

Devices of the present invention may be equipped with security features that require supervisor approval for some actions taken. For example, a casino might want only a pit supervisor to do the initial shoe setup. Another example of the invention requires supervisor approval for the decision to use/burn or discard a card that was drawn but not read, drawn in error (i.e., an extra card was drawn), or drawn and misread.

Card-handling devices of the present invention advantageously allow the user to burn cards at any time during the use of the machine, from the initial power-up until the last card has been removed from the shoe. According to the invention, a card-handling device is provided that includes an area for holding a group of cards, an output end for removal of cards, a card-reading system for identifying card value information, a processor and associated memory, wherein the processor is programmed with game rules and to receive read card information from the card-reading system, and a user input to enable a user to burn at least one card at any time such that the burned card is disregarded in determining game outcome.

Casino house procedures sometimes require a dealer to burn one or more cards at the beginning of a new shoe, at the beginning of a round of play or on some other basis. The casino might want to have the flexibility to implement card-burning procedures in response to a misread, a no-read, the detection of an unexpected card or upon some other occurrence. For this reason, devices of the present invention include a user input that allows the dealer to burn cards at any point of use, including before play begins, after play begins, during play, at the conclusion of play and at any other time (providing the machine has power and is loaded with at least one card). Preferably, the device is a shoe.

In one embodiment of the invention, the card recognition system recognizes a cut card. The system may be trained to recognize a blank card as a cut card, or may be trained to recognize specialized graphics or other optical qualities of the cut card. When the cut card is reached, a user display in one embodiment of the invention preferably prompts the user to burn the remaining cards. The user inputs a "burn the rest" command (or the system prompts the dealer to burn the rest of the cards) and the dealer removes the remaining cards to complete the running inventory record. At this time, the processor compares the running inventory record with the expected inventory record and issues a signal if the data files do not match.

The running inventory data file is stored in the associated memory, in one embodiment of the invention, and the user input enables the user to enter a command and then remove all cards after the cut card is recognized to obtain a total inventory. In one example of the invention, the processor compares the total inventory to the expected values to determine whether the data files are the same.

When a signal indicating a discrepancy or inequality between the final running inventory and the expected inventory values is received, the processor determines the nature of the discrepancy and issues a report. The report may be displayed on a user display, printed in a report or uploaded to an external computer or network data storage.

In one example of the invention, a user may input a burn card command prior to a hand, prior to a round of play, at the beginning of a new shoe, during play, at a conclusion of play, and when a cut card is detected. The shoe may even be left in the "burn card" mode after the shoe has been emptied so that when a new set of cards is loaded, the shoe is already ready for the dealer to burn cards according to house procedure. In one form of the invention, a burn command allows the user to burn one card. In another form of the invention, a burn command sets the machine so all pulled cards are burned until the burn command is reversed by another user command.

Some devices of the present invention provide user inputs that enable the user to disable the card-reading function. This function might be desirable if the dealer observes that the system is not functioning with complete accuracy. The ability to disable the card-reading function may be viewed as a security issue and, for this reason, in one embodiment, this function can only be disabled by proving the user has sufficient security access, such as by accessing a password-protected supervisor screen on the shoe's display with touch screen controls.

Card-handling devices of the present invention may be provided with a number of setup options that have one or more levels of password protection. For example, the game option menu may require supervisor approval in order to set up the device for a particular game. Other options, such as whether a "burn" command is limited to one card, or whether the command means "burn until the burn card input is hit again" may be set by a dealer or by management. An alternative to password protection is to provide encrypted signatures, physical keys, face recognition, fingerprint ID, swipe card ID, and any other known means of identifying a person and level of authority.

Card-handling devices and methods of the present invention may be used in connection with other games aside from traditional baccarat. Non-limiting examples include: mini-baccarat; conventional blackjack; blackjack side bets, including Shuffle Master, Inc.'s ROYAL MATCH 21®, BET THE SET "21"®, and BLACKJACK PLUS ADDS™; baccarat variants, such as Shuffle Master, Inc.'s DRAGON BONUS® side bet; and other "shoe" games, such as Shuffle Master, Inc.'s CASINO WAR®.

Card-handling systems of the present invention may be used as a stand-alone component on a live table game, or may be integrated into a gaming platform, such as a semi-automatic gaming platform that enables the play of card games using physical cards while requiring credit wagering.

Semi-automatic gaming platforms preferably incorporate a mechanized shoe that is capable of moving cards from a storage area to an output end. Cards are imaged prior to removal from the output end in a first preferred structure. Because the shoe (or shuffler) is integrated into the platform, data derived from the shoe historical data may be correlated with play data to obtain more detailed information.

In one preferred shoe structure, the cards are imaged in a staging area located between the storage area and the output end. Cards are moved by a first card mover from the storage area to an imaging area. Imaged cards are moved by a second card mover to an output end for manual delivery of individual cards to players. An example of one suitable mechanized shoe design is described in detail below. Although the mechanized shoe described below is one suitable card-handling device that can be used as a component of systems of the present invention, it is to be understood that alternative shoe structures can be used in place of the structure described below. For example, in patent application Ser. No. 12/228,713, filed Aug. 15, 2008, and assigned to Shuffle Master, Inc., an alternate mechanized shoe structure with card-reading capability is disclosed, which can be used in place of the shoe structure described below. This application is hereby incorporated by reference.

Playing Card Delivery Device

One exemplary playing card delivery device of the present invention is a mechanized shoe. The exemplary dealing shoe is implemented specifically for use in the play of baccarat. However, this shoe design can be modified so that it is suitable for dealing cards into any "shoe" type game, including blackjack, baccarat, blackjack variants, baccarat variants, mini baccarat, CASINO WAR® and any other game that is traditionally dealt out of a shoe.

The exemplary shoe provides additional functions without greatly increasing the space on the casino tabletop used by the typical non-mechanized dealing shoe. The shoe provides cards securely to a card delivery area and reads the cards before they are actually nested in the card delivery area. The card information is either stored in memory associated with the shoe, transferred to memory associated with an external game controller or transferred via a network connection to a central computer for storage and/or evaluation. The cards are mechanically transferred from a point of entry into the dealing shoe to the card delivery area, with a buffer area in the path where at least some cards are actually held for a period of time. The cards are preferably read before they are delivered into the card delivery area.

Reference to the figures will help in an appreciation of the nature and structure of one embodiment of the card delivery shoe of the invention that is within the generic practice of the claims and enables practice of the claims in this application.

FIG. 1 shows a side elevational view of a card delivery shoe 2 according to the present invention. The card delivery shoe 2 has a card infeed or card input area 4 that is between a belt-driving motor 6 and a card delivery area 36 of the card delivery shoe 2. The card input area 4 allows cards to be stacked vertically (cards oriented horizontally and face down). The belt-driving motor 6 drives a belt 8 that engages pick-off rollers 10*a* and 10*b*. These pick-off rollers 10*a*, 10*b* pick off and move individual cards from within the card infeed area 4. The lowest card in the stack (not shown) contacts pick-off rollers 10*a*, 10*b*, which separate the card from the stack. A belt-driving motor 6 is shown, but other motor types, such as gear drives, axle drives, magnetic drives, and the like, may be alternatively used. The pick-off rollers 10*a*, 10*b* drive individual playing cards (not shown) into gap 14 located beneath a substantially vertical deflector plate 15 to direct cards individually and horizontally through the gap 14 to engage brake rollers 16*a*, 16*b*. The brake rollers 16*a*, 16*b* control the movement of individual cards from the card input area 4 and into a card staging area 34.

The brake rollers 16*a*, 16*b* are capable of becoming free-turning rollers during a card jam recovery process so that little or no tension is placed on a card as it is being moved by the system or manually to free a jam. A simple gear release or clutch release can effect this function. Speed-up rollers 17*a*, 17*b* apply tension to a card to move it further into the card staging area 34. The speed-up rollers 17*a*, 17*b* can and may turn faster than the brake rollers 16*a*, 16*b* and the speed-up rollers 17*a*, 17*b* may be driven by a separate motor 19 and belt drive 21. A card path and direction of movement A is shown through the card staging area 34. As individual cards are passed along the card path A through the card staging area 34, there are card presence sensors 18, 20, and 22 located at various intervals and positions to detect the presence of cards to assure passage of cards and/or to detect stalled or jammed cards. The card path A through the card staging area 34 is, in part, defined by speed-up rollers 17*a*, 17*b* or rear guide rollers 24*a*, 24*b* and forward guide rollers 26*a*, 26*b*, which follow the brake rollers 16*a*, 16*b* and the speed-up rollers 17*a*, 17*b*. One form of a buffer area 48 is established by the storing of cards along card path A. As cards are withdrawn from the card delivery area 36 of the card delivery shoe 2, additional cards are fed from a buffer area 48 into a card feed chute 46 into the card delivery area 36.

It is always possible for cards to jam, misalign or stick during internal movement of cards through the dealing shoe. There are a number of mechanisms that can be used to effect jam recovery. The jam recovery may be based upon an identified (sensed) position of a jam or may be an automated sequence of events. Where a card jam recovery is specifically identified by the sensed position of a jammed card in the device (and even the number of cards jammed may be estimated by the dimensions of the sensed image), a jam recovery procedure may be initiated at that specific location. A specific location in FIG. 1 within the card delivery shoe 2 (e.g., between and inclusive of rollers 16*a*, 16*b* and 17*a*, 17*b*) will be discussed from an exemplary perspective, but the discussion relates to all other positions within the device.

If a card is sensed (e.g., by sensors 18 and/or 20) as jammed between rollers 16*a*, 16*b* and 17*a*, 17*b* (e.g., a jam occurs when cards will not move out of the position between the rollers 16*a*, 16*b* and 17*a*, 17*b* and cards refuse to be fed into that area), one of a various number of procedures may be initiated to recover or remove the jam.

Among the various procedures to recover or remove the jam, by way of non-limiting example, at least the following are included. The rear-most set of brake rollers 16*a*, 16*b* may reverse direction (e.g., brake roller 16*b* begins to turn clockwise and brake roller 16*a* begins to turn counterclockwise) to remove the jammed card from between the brake rollers 16*a*, 16*b* and have the card extend backwards into the gap 14, without attempting to reinsert a card into the card infeed area 4. The reversed rotation may be limited to assure that the card remains in contact with the brake rollers 16*a* and 16*b*, so that the card can be moved back into progression through the card delivery shoe 2. An optional part of this reversal can include allowing speed-up rollers 17*a* and 17*b* to become free-rolling to release contact and tension on the card during the reversal. The reversed rotation may be smoothly run or episodic, attempting to jerk a jammed card from its jammed position. If that procedure does not work, or as an alternative procedure, both sets of rollers 16*a*, 16*b* and 17*a*, 17*b* may reverse at the same time or in either sequence (e.g., rollers 16*a*, 16*b* first or rollers 17*a*, 17*b* first) to attempt to free the jam of a card.

When one set of rollers only is turning, it is likely to be desirable to have the other set of rollers in the area of the jam to become free-rolling. It is also possible to have the rollers automatically spaced further apart (e.g., by separating roller pairs to increase the gap in the potential nip between rollers) to relieve tension on a card and to facilitate its recovery from a jam. The adjacent pairs of rollers (e.g., rollers 16*a*, 16*b* and 17*a*, 17*b*) can act in coordination, in sequence, in tandem, in order, independently or in any predefined manner. For example, referring to the roller sets as 16*a*, 16*b* and 17*a*, 17*b*, the recovery process may have the rollers act as a) rollers 16*a*, 16*b* and 17*a*, 17*b* at the same time in the same direction; b) rollers 16*a*, 16*b* and 17*a*, 17*b* at the same time in opposite directions to assist in straightening out cards; c) rollers 16*a*, 16*b*, then rollers 17*a*, 17*b*, to have the rollers work sequentially; d) rollers 17*a*, 17*b*, then rollers 16*a*, 16*b*, to have the rollers work in a different sequence; e) rollers 16*a*, 16*b* only for an extended time, and then rollers 17*a*, 17*b* operating alone or together with rollers 16*a*, 16*b*; f) 17*a*, 17*b* only for an extended time or extended number of individual attempts, and then rollers 16*a*, 16*b* for a prescribed time, etc. As noted earlier, a non-active roller (one that is not attempting to drive or align cards) may become free-rolling during operation of another roller.

These various programs may be performed at a single jam location in series or only a single program for jam recovery may be effected. In addition, as the card may have been read at the point of the jam or before the jam, the rank and value of the jammed card may be identified and this can be displayed on the display panel on the dealing shoe, on the central computer or on a shuffler connected to the dealing shoe, and the dealer or pit boss may examine that specific card to make certain that no markings or damage have occurred on that card, which could either cause further problems with the dealing shoe or shuffler or could enable the card to be identified when it is in the dealing position in the shoe at a later time. The pit crew can then correct any problem by replacement of that specific card, which would minimize downtime at the card table. Also, if a jam cannot be recovered, the delivery shoe would indicate a jam recovery failure (e.g., by a special light or alphanumeric display) and the pit crew would open the device and remove the jam manually.

Electronic Cut Card—This is a feature provided by software in the programming of the system. This function may be disabled in one embodiment of the invention. This is not a physical card that is in the shoe. Instead, the software program generates an "electronic cut card position" that acts like a real cut card when delivering cards. After the cut card is performed electronically and the position of the card cut determined in the real card deck or stack of multiple decks, the playing cards are dealt until the cut card position (a position determined as being after a card, between cards, before cards, or at a specific card acting as the cut card) is reached. When that electronic cut card position is reached, the shoe will provide either a visual indication or an audible signal to tell the dealer to finish delivering cards to the round and then stop dealing. The position of the cut can be generated randomly by a random number generator, with parameters selected (such as greater than 50% of all cards present and fewer than 75% of all cards present) or at a fixed value, for example, of about two cards for each 52-card deck present in the shoe. The system of the present invention can also verify a deck of cards once all the cards are removed. Once the cut card has come up, the dealer can remove the remaining cards individually, allowing each card to be scanned. The processor can then perform a card check function where all cards removed from the shoe are scanned in the usual way and the rank and suit are compared to a stored set of card values and any deviations from the reference values are reported in the form of a report. The report can be displayed or printed.

Stop Card Delivery State—This is also an optional feature. It can be disabled during initial configuration, or whenever the operator chooses to take the device out of service. The baccarat shoe is controlled such that the shoe stops delivering cards whenever certain security-compromising events occur in the use of the shoe. By way of non-limiting example, events such as when the back door of the shoe is open, an inaccurate card count occurs, excess cards are found, a deficiency of cards is found, or there is a misdeal, can generate a signal that, in turn, initiates a "stop card delivery state" automatically in the baccarat shoe. During this event, a sound alert and/or visual alert may be triggered. The dealer or user must either press a continue button or swipe an authorization card, or do both, to continue or to restart the baccarat shoe. In other embodiments, the dealer must use a key, input a secret code or use encryption techniques to restart the delivery of cards.

In the case of door opening: There may be a security device, such as a small magnetically sensitive electric sensor on the shoe located proximate to or near the door, that senses when the door is open. Other security systems, like a programmable key, may also be used to access the door. This sensor is communicatively connected to the microprocessor that is inside of the shoe and sends a "door open" signal (e.g., a status signal) to an external processor, such as a game table processor, pit processor, central processor or an external mini PC. When the processor (such as the external mini PC) receives this signal, it commands the shoe to stop delivering cards until it receives a "continue" command. In alternate embodiments, the shoe's internal processor is capable of recognizing predetermined conditions that require card delivery stoppage, and to deactivate the card delivery mechanisms.

In the case of a misdeal: The system is able to detect misdeals from a number of different events that are sensed, measured or detected in the operation of the shoe. When the processor, such as the mini PC or the shoe's internal processor, receives a "misdeal" signal, the processor commands the shoe to stop dealing, or, if the shoe responds to a status signal, upon receipt of this status signal, the shoe will self-initiate a "stop deal" event. To continue dealing, the shoe may require the same restart method as described above for the door-opening event. When the shoe stops dealing cards for any of these reasons, all of the data that has been generated at that time will remain in the memory. The stop deal event is not a "reset" type of event, but rather is an "interrupt" or delay event, where all information and status remains current and collective.

Supervisor Swipe Card—This is an optional feature that can be disabled or enabled during initial configuration or at any other time the user wishes to take the equipment out of service and reconfigure it. When the shoe is in the "stop card delivery" routine or "stop deal" routine, a special card is required to swipe through the system in order to resume delivering cards. This card contains information that is needed to trigger the processor, such as the mini PC or shoe processor, to send a "continue to deal" signal to the card-moving elements of the shoe, and it may be an apparatus similar to that used by a dealer ID module that is used in intelligent table systems. Information may be provided by magnetic, optical, bar code, or other readable information fed into the module, scanner or reader. The information is sent to the processor, such as the external mini PC or shoe processor, which provides a signal or command that triggers the shoe to continue dealing. Usually, only casino supervisors have access to the swipe card, for security purposes.

A Light Indication Feature—Because the color red is considered to be unlucky in some cultures, a choice of colors of the lights may be provided. This option allows users (casinos) to select different colors on site (when configuring the shoe for local casinos) to indicate banker win, player win, and tie. The available colors are at least red, blue, green, yellow, and orange. In general, the shoe is configurable so that it is easy to add different features to fit different specifications, which offer more flexibility to customers.

In other embodiments of the shoe (not shown), individual playing cards may be read at one or more various locations within the card delivery shoe. The ability to provide multiple read locations assures more accurate card reading, as compared to other card-handling devices that read cards in a single reading position at the point where and when cards were removed from the shoe for delivery to players.

For example, in the construction shown in FIG. 1, the card presence sensors 18, and 22 may also have card-reading capabilities, and other card-reading sensors may be present as elements 32, 40 and 42. Element 38 may be optionally present as another sensing element or a card value (and possibly suit) reading element without the presence of sensor 22 or in combination with sensor 22. When the sensor 38 functions as a card-reading element, it should read the cards as they are positioned in a card pre-delivery area 37, rather than as the cards are removed from the card delivery area 36. Information may be read by the card-reading sensor 38 by either continuous reading of all image data in the card pre-delivery area 37 or by triggered on-off imaging of data in a specific region 39 as a card 41 is positioned within the card pre-delivery area 37. For example, card presence sensor 22 may activate card-reading sensor 38. This sensor 38 is preferably a camera, but could be any radiation-sensing device, such as a photocopy machine scanner. A light source (not shown) may be provided to enhance the signal to the sensor 38. That specific region of cards is preferably a corner of the card 41 wherein complete value information (and possibly suit information) is readable on the card 41, such as a corner with value and suit-ranking symbols on the card 41. That region could also be the entire face of the card 41, or at least one-half of the card 41 (divided lengthwise). By increasing the area of the region read more processing and memory is required, but accuracy is also increased. Accuracy could also be increased by reading the upper right-hand corner of the card 41 and lower left-hand corner, since both of those locations contain the rank and suit of the card 41. By reading two locations on the card 41, reading errors due to defects or dirt on the card can be avoided. By using on-off or single-shot imaging of each card 41, the data flow from the sensor/card-reading element 38 is reduced and the need for larger memory and data transmission capability is reduced in the system.

Information may be transferred from the card-reading elements (e.g., 32) from a communication port or wire 44 shown for sensor/reading element 32 to an external processor. Alternatively, the captured data may be processed by the internal processor. U.S. patent application Ser. No. 11/152,475, filed Jun. 13, 2005, now U.S. Pat. No. 7,769,232, issued Aug. 3, 2010, describes a suitable technique for processing captured signals within a shoe or a shuffler. The content of this disclosure is hereby incorporated by reference in its entirety.

Cards may be buffered or staged at various points within the card delivery shoe 2, such as where restrained by rollers 26*a*, 26*b* so that cards partially extend toward the chute 46 past the rollers 28 on plate 43, or staged between rollers 24*a*, 24*b* and 26*a*, 26*b*, between rollers 17*a*, 17*b* and 24*a*, 24*b*, between rollers 16*a*, 16*b* and 17*a*, 17*b*, and the like. Cards may partially overlap in buffering as long as two or more cards are not present between a single set of nip rollers (e.g., 26*a* and 26*b*) where nip forces may drive both cards forward at the same time.

Other variations are available and within the skill of the artisan. For example, rear panel 12 may have a display panel thereon for displaying information or data, particularly to the dealer (which information would be shielded from players, as the rear panel 12 would primarily face the dealer and be shielded from players' view). A more ergonomic and aesthetic rear surface 50 is shown having a display 52 that is capable of providing alphanumerics (letters and numbers) or analog or digital images of shapes and figures in black and white or in color. For example, the display may give messages as to the state of the shoe, time to number of cards dealt, the number of deals left before a cut card or virtual cut card is reached (e.g., the dealing shoe identifies that eight decks are present, makes a virtual cut at 250 cards, and based on data input of the number of players at the table, identifies when the next deal will be the last deal with the cards in the shoe), identify any problems with the shoe (e.g., low power, card jam, where a card is jammed, misalignment of cards by rollers, and failed element, such as a sensor), player hands, card rank/suit dispensed, and the like. Also on the rear surface 50 are two lights 54 and 56, which are used to show that the card delivery shoe 2 is ready for dealing (e.g., 54 is a green light) or that there is a problem with the dealing capability of the card delivery shoe 2 (e.g., 56 is a red light). A memory board 58 for the card-reading sensor 38 is shown with its communication outlet port 44.

An alternative card-handling device is an automatic card shuffler with card-reading capability. An exemplary card-shuffling device is described in U.S. patent application Ser. No. 11/598,259, filed Nov. 9, 2006, now U.S. Pat. No. 7,766,332, issued Aug. 3, 2010. This exemplary card shuffler is a single-deck batch shuffler that delivers hands of cards to a single delivery tray. When a hand is removed from the delivery tray, another hand is automatically delivered. The card values are determined in the device and hand composition data is available for use by the shuffler itself. Hand composition data can also be transferred through a data port to an external computer or uploaded via a network connection to a database. The shuffler has a carousel structure with multiple compartments for randomizing cards. Cards may be retained in the carousel structure and delivery to the delivery tray prevented when a predetermined condition is detected.

Common Display

The shoe of the present invention may supply data to a common player and/or pit display. Preferably a display panel (not shown) is provided for viewing by the dealer and/or other pit personnel. The display panel may be any panel that can conveniently provide alphanumeric data on it, and the screen display can be configured or tailored by the user with software that is provided in the processor or in one or all of multiple processors. By way of a non-limiting example, the reader board of the present invention is presently provided as a 19-inch or 21-inch (diagonally measured) plasma screen (although CRT, LED, semiconductor, liquid crystal or other displays would be satisfactory) that is connected to the external mini PC of the smart shoe via an analog or digital video port. It is placed next to the game table where players can easily see the history of the game, or, alternatively, it may be positioned for view by management only.

When the shoe is configured to administer the game of baccarat, an external PC may be programmed with the game rules. In alternate embodiments, the game rules are executed by a computer internal to the shoe. The system has the capability of determining hand composition and the outcome of each round as or even before the hand is played. The card-reading baccarat shoe generates a log or record that contains critical information such as player's hand, banker's hand, and the game outcomes (player, banker and tie hands), and the history of such records. This information may be sent out from the mini PC and may be displayed on the plasma screen. Even though it is possible to display the game result in real time (as soon as the cards are removed from the shoe), it is often desirable to allow the players to sweat the hands (looking for the values slowly) to keep the mysterious atmosphere of the game, and the information may then be displayed with a time delay. The duration of the delay time is variable upon user's requests that can be input into the processor. A control screen with touch screen, mouse, panel, keyboard or other input can be provided to set the duration of the delay, and whether or not there will be a delay. The control panel (which can be displayed on the display screen to enhance user-friendliness) can accept input for stylizing the display, adjusting the content of the information (e.g., show card suits or display card values only), provide instructions to the dealer on required or disallowed activity, and show a record of the hand activity (e.g., percentages of player hand wins, banker hand wins, ties, ongoing streaks of hand wins, specific time history of hand round history, etc.).

Although one preferred configuration is to have an external computer that communicates with both the display and the mechanized shoe, other configurations are contemplated, such as the display being in communication directly with the shoe and the shoe being in communication with a casino network, or both the display and the shoe being in communication with the network.

The display panel may also provide dealer action or player action signals with an option for highlighting the actions on the display screen. When the game is baccarat, the display panel is used by all players. When the game rules require the players to receive individual hands of cards, the players could have their own dedicated display panel. For example, because the rules of play of baccarat are so rigid and there is not optional play in the delivery of the cards, the rules can be programmed into the processor (internal or external to the shoe) with certainty based upon the cards provided to the player hand and the banker hand and the corresponding information received by the processor. When the initial two banker cards and initial two player cards have been dealt and then revealed upon the display screen, the processor program will identify the next steps to be taken in the game. If the player is to receive a card according to the rules, the player's hand may be highlighted on the player display (e.g., flashing numbers, specific coloration of the words "player" or "player's hand," audio information such as "deal to player!" or other audible or visible indications on the screen and any associated speakers) or the banker's hand highlighted on the screen. There may be a small delay on changes in the screen to allow the players to assess events, such as when the player's hand is revealed and either a hit is required, no hit is allowed (because of a player's or banker's natural hand), and/or the banker must take a hit. The delays are added to provide a period of appreciation for the play of the game rather than processing hands so rapidly the system would operate as does a video gaming device during tournament play, with rapid turnover of the games, but no individual game appreciation.

Written (alphanumeric) descriptions of events may also be provided on the screen. For example, the words "player natural," "banker natural," or just "natural" with the winning or fixed hand may be provided on the display screen. Additionally, "tie" or "draw" can be displayed, or "player win," "banker win" or "tie" can be displayed.

FIG. 2 shows a sample of a simple display screen 59 format. On the left of the display screen 59 is shown the recent historical game tracking of P (player wins), B (banker wins) and T (ties), and their recent historical game outcome sequence and an ongoing percentage analysis. Longer intervals of play may be displayed, various trend formats may be used, and the ongoing history of percentage analysis may be provided for the period of the display or longer (e.g., dealer history, shift history, day history, week history, etc.). The display may be format-static during play, or the dealer may easily change the display format (semi-permanently or temporarily) at the request of the players at the table. This can provide increased player entertainment and discussion at the table, while enabling the casino and players to better chart events at the table. It can also provide information that can encourage wagering by providing information that players could believe provides them with a better judgment of future events.

The display screen 59 may show the hands played and the count of the hands (both the final count (modulo ten) and a count during play). The suits may or may not be displayed, as suits are immaterial to normal baccarat play. The system may also be programmed for displays that are compatible with or enhance bonus events, jackpot events, or alternative baccarat rules and features in baccarat-type or poker derivative games (such as a THREE CARD POKER® on the first three displayed cards in the game, a FOUR CARD POKER® game wager on the dealer's and player's initial four cards, up to a FOUR CARD POKER® game hand for a total count of up to six cards in the play of the game of poker (three player cards and three dealer cards)). All of the desired information, including poker hand determination and payouts, can be displayed on the display screen at the appropriate times. The display or an additional display may be provided that is accessible only to management. This house display could be used to display historical information from the table, player betting history, and the like. Burn cards (not shown) can be displayed if this option is selected in the setup menu of the display's computer.

A lower panel or segment of the panel on a player display screen can provide streaming video for informational or advertising purposes (where FIG. 2 shows "Ticker Scroll for Advertising"). Various formats and types of information can be provided, including, but not limited to, advertising (especially for casino events and facilities), specific player announcements (e.g., "Mr. Dunn, Dinner Reservation at La Maison in 10 Minutes"), sports scores, desk service call to patron, and the like.

In one embodiment, an extra button is located on the card-handling device that acts as a signal control. The game information will not be displayed until the button has been pressed and, therefore, the dealer can decide the best time to display game results.

There are significant technical and ergonomic advantages to the present structure of the baccarat shoe that is used in conjunction with the display screen and program for information display. By having the card infeed area 4 (FIG. 1) provide the cards in at least a relatively vertical stack (e.g., with less than a 60° slope of the edges of the cards away from horizontal), the length of the card delivery shoe 2 (FIG. 1) is reduced to enable the motor-driven delivery and reading capability of the card delivery shoe 2 (FIG. 1) in a moderate space. No other card delivery shoes are known to combine vertical card infeed, horizontal (or approximately horizontal, e.g., a ±40° slope or ±30° slope away from horizontal) card movement from the infeed area to the delivery area, with mechanized delivery between infeed and delivery. The motor drive feed from the vertical infeed also reduces the need for dealers to have to jiggle the card tray to keep cards from jamming, slipping to undesirable angles on the chutes, and otherwise having to manually adjust the infeed cards, which can lead to card spillage or exposure as well as delaying the game.

Figure 3:
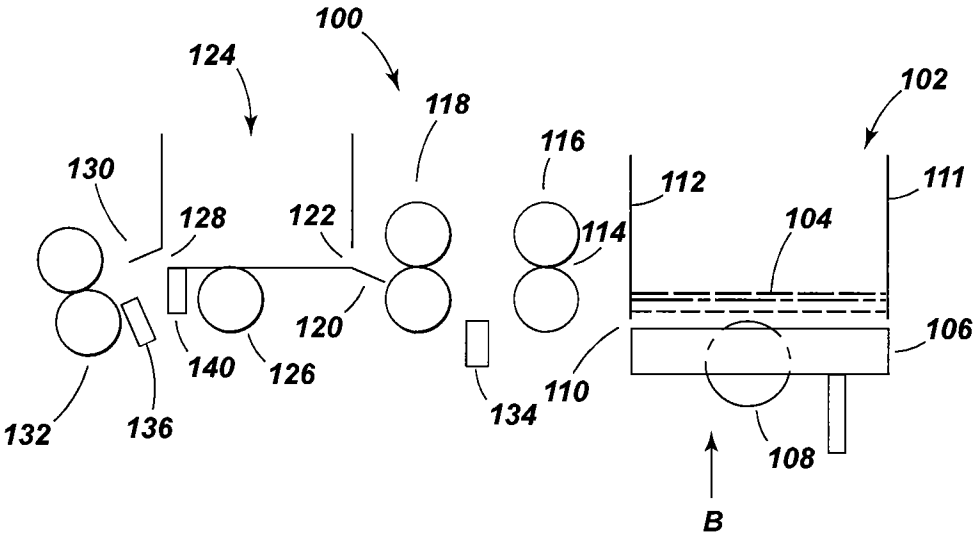
FIG. 3 shows a schematic diagram of a second embodiment of a card delivery shoe having a card-reading and buffer area.

FIG. 3 shows an alternative embodiment for internal card-buffering and card-moving elements of a card delivery shoe 100. A card infeed area 102 is provided for cards 104 that sit between walls 111 and 112 on elevator or stationary plate 106, which moves vertically along path B. A pick-off roller 108 drives cards one at a time from the bottom of the stack of cards 104 through opening 110 that is spaced to allow only one card at a time to pass through the opening 110. The elevator 106 is lifted in direction B such that the opening 110 is aligned horizontally with nip area 114. Individual cards are fed into the nip area 114 of the first set of speed control or guide rollers 116 and then into the second set of speed control or guide rollers 118. The cards passing through guide rollers 118 one at a time are shown to deflect against angled plate 120 so that cards deflect upwardly as they pass into opening 122 and will overlay any cards (not shown) in card buffer area 124. A second pick-off roller 126 is shown within the card buffer area 124 to drive cards through opening 128 one at a time. The individual cards are again deflected by a plate 130 to pass into guide rollers 132 that propel the cards into a card delivery area (not shown) similar to the card delivery area 36 in FIG. 1. Card-reading elements may be positioned at any convenient point within the card delivery shoe 100 shown in FIG. 3, with card-reading elements 134, 136 and 140 shown in exemplary convenient locations.

Figure 4:
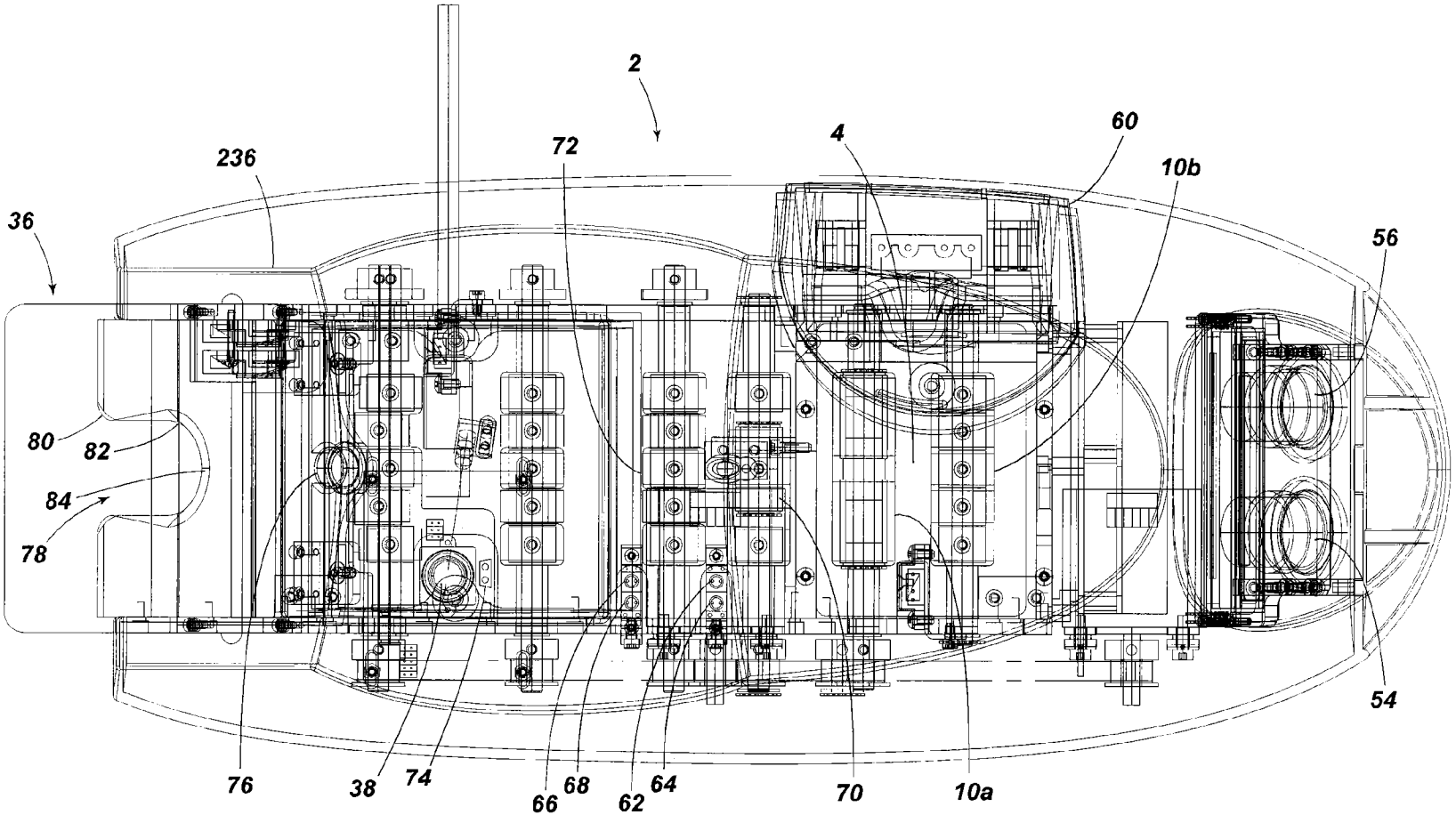
FIG. 4 shows a top plan view of the first embodiment of the card delivery shoe of FIG. 1 according to the present invention.

FIG. 4 shows a top plan view of the card delivery shoe 2 of an embodiment of the present invention. A flip-up door 60 allows cards to be manually inserted into the card input area 4. The set of pick-off rollers 10*a* and 10*b* are shown in the card input area 4. The position of sensors 62, 64, 66 and 68 is shown outwardly from sets of five brake rollers 70 and five speed-up rollers 72. While the sensors are shown in sets of two sensors, which is an optional construction, single sensors may be used. The dual sets of sensors (as in 62 and 64) are provided with the outermost sensor 64 simply sensing card presence and the innermost sensor 62 reading the presence of a card to trigger the operation of the camera card-reading sensor 38 that reads at least value and, optionally, rank and suit of cards. The sensor 66 alternatively may be a single sensor used as a trigger to time the image sensing or card reading performed by camera 38 as well as sensing the presence of a card. An LED light panel 74 or other light-providing system is shown present as a clearly optional feature. A sensor 76 at the card delivery area 36 of the card delivery shoe 2 is provided. A finger slot opening 78 that is an inverted "U" shape is shown at the card delivery area 36 of the card delivery shoe 2. A lowest portion 80 of the finger slot opening 78 is narrower than a top portion 82 of the finger slot opening 78. Walls 84 of the output end of the card delivery shoe 2 may also be sloped inwardly to the card delivery shoe 2 and outwardly toward the finger slot opening 78 to provide an ergonomic feature to the finger slot 78.

The term "camera" is intended to have its broadest meaning to include any component that accepts radiation (including visible radiation, infrared, ultraviolet, etc.) and provides a signal based on variations of the radiation received. This can be a digital camera or an analog camera with a decoder such as a digitizer, or receiver that converts the received radiation into signals that can be analyzed with respect to image content. The signals may reflect either color or black-and-white information or merely measure shifts in color density and pattern. Area detectors, semiconductor converters, optical fiber transmitters to sensors, or the like, may be used. Any convenient software may be used that can convert radiation signals to information that can identify the suit/rank of a card from the received signal. The term "camera" is not intended to be limited in the underlying nature of its function. Lenses may or may not be needed to focus light, mirrors may or may not be needed to direct light and additional radiation emitters (lights, bulbs, etc.) may or may not be needed to assure sufficient radiation intensity for imaging by the camera.

There are a number of independent and/or alternative characteristics of the delivery shoe that are believed to be unique in a device that does not shuffle, sort, order or randomize playing cards. 1) Shuffled cards are inserted into the shoe for dealing and are mechanically moved through the shoe but not necessarily mechanically removed from the shoe. 2) The shoe may mechanically feed the cards (one at a time) to a buffer area where one, two or more cards may be stored after removal from a card input area (before or after reading of the cards) and before delivery to a dealer-accessible opening from which cards may be manually removed. 3) An intermediate number of cards are positioned in a buffer zone between the input area and the removal area to increase the overall speed of card feeding with rank and/or suit reading and/or scanning to the dealer. 4) Sensors indicate when the dealer-accessible card delivery area is empty and cards are automatically fed from the buffer zone (and read then or earlier) one at a time. 5) Cards are fed into the dealer shoe as a vertical stack of face-down cards, mechanically transmitted approximately horizontally, read, and driven into a delivery area where cards can be manually removed. 6) Sensors detect when a card has been moved into a card-reading area. Signal sensors can be used to activate the card-reading components (e.g., the camera and even associated lights) so that the normal symbols on the card can be accurately read.

With regard to triggering of the camera, a triggering mechanism can be used to set off the camera shot at an appropriate time when the card face is expected to be in the camera focal area. Such triggers can include one or more of the following, such as optical position sensors within an initial card set receiving area, an optical sensor, a nip pressure sensor (not specifically shown, but which could be within either nip roller (e.g., 16*a*, 16*b* or 17*a*, 17*b*)), and the like. When one of these triggers is activated, the camera is instructed to time its shot to the time when the symbol-containing corner of the card is expected to be positioned within the camera focal area. The card may be moving at this time and does not have to be stopped. The underlying function is to have some triggering in the device that will indicate with a sufficient degree of certainty when the symbol portion of a moving or moved card will be within the camera focal area. A light associated with the camera may also be triggered in tandem with the camera so as to extend the life of the light and reduce energy expenditure in the system.

The shoe described above, as well as other mechanized shoes may be integrated with other components, subcomponents and systems that exist on casino tables for use with casino table games and card games. Elements such as bet sensors, progressive jackpot meters, play analysis systems, wagering analysis systems, player comping systems, player movement analysis systems, security systems, and the like, may be provided in combination with the baccarat shoe and system described herein.

Newer formats for providing the electronics and components may be combined with the baccarat system. For example, new electronic table systems may be used in connection with a mechanized shoe to increase table productivity and to provide security features that were not available prior to this invention. For example, a chipless table that includes a gaming table surface, multiple electronic player interfaces enabling players to place electronic wagers and to input play decisions, and a game controller may be combined with the exemplary mechanized shoe to provide an integrated, highly secure semi-automatic gaming system.

Chipless Table

An exemplary chipless table system (an example of a semi-automatic gaming system) that may be used to detect and respond to predetermined conditions includes at least the following components: a) at least one operatively associated dealer PC or main game controller (hereinafter the "game controller"); b) at least one electronic playing card delivery device with card-reading capabilities in communication with the game controller; c) a plurality of electronic player interfaces mounted at the casino table wagering interfaces that communicate at least with the game controller; d) a dealer interface in communication with the game controller; e) a detection system that can identify at least one predetermined condition (such as a card-dealing error) and that communicates that detected condition or event to the game controller; f) the game controller and/or the detection system in communication with the playing card delivery system to transmit an indication of the condition or event to the electronic playing card delivery device; g) the electronic playing card delivery device having at least one response to at least one detected condition that stops card feed and/or interrupts further game activity; and h) at least one playing card delivery error reset protocol on a dealer interface and/or on the electronic card-handling device user interface that will discontinue the stop function, allowing card delivery to resume.

An exemplary chipless table system is disclosed in U.S. patent application Ser. No. 12/218,583, filed Jul. 15, 2008, now U.S. Pat. No. 8,262,475, issued Sep. 11, 2012, and U.S. patent application Ser. No. 12/231,759, filed Sep. 5, 2008, now U.S. Pat. No. 8,251,801, issued Aug. 28, 2012, which are herein incorporated by reference in their entireties.

In one embodiment, an overhead camera system with image processing capabilities is provided and is in communication with the game controller. The overhead camera imaging system collects data that is transmitted to the game controller and is used to detect conditions that would trigger the card-handling device to stop delivering cards. An example of a suitable overhead camera system is described in U.S. patent application Ser. No. 11/558,810, filed Nov. 10, 2006, the content of which is incorporated by reference. The overhead camera imaging system could be used to detect when a card has been dealt to a player position when that action was inappropriate. For example, if a player wanted to stand on a blackjack hand of 17, and the dealer dealt the card to the player anyway, the overhead card-imaging system could collect that data and the game controller would then determine that the dealer action was a condition that triggered the card-handling device to stop moving cards to a delivery end of the device or to issue a dealer alert.

Figure 5:
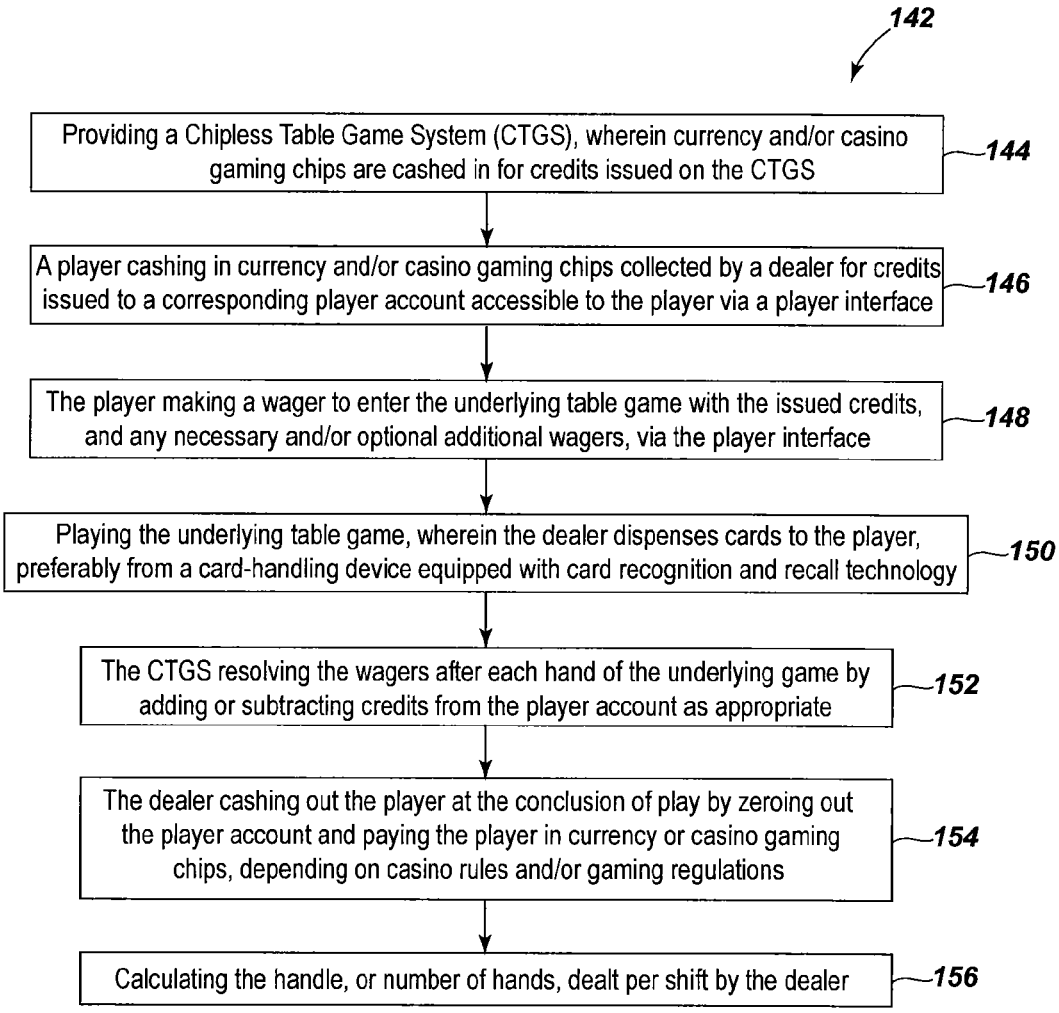
FIG. 5 is a flow diagram of an exemplary process of operating a game on a chipless gaming table.

FIG. 5 is a flow diagram for methods of using a chipless table, generally referred to as numeral 142. A chipless table gaming system (CTGS) is provided at step 144. CTGS generally has a dealer station with a dealer interface and a plurality of player stations, each including an electronic player interface, such as a touch screen, and operates with purchased credits instead of casino gaming chips. At step 146, a dealer "cashes in" a player wishing to join the underlying table game by accepting currency or casino gaming chips and issuing credits for a player to wager with to the corresponding player account accessible to the player via the player interface.

At step 148, the player makes a wager to enter the underlying table game using the credits and also makes any other necessary or optional additional wagers to continue play via the player interface. Then at step 150, the underlying table game proceeds as usual and the player plays the game. The dealer dispenses physical cards to the player, preferably from a card-handling device equipped with card recognition and/or hand recall technology. Card-handling devices and methods of the present invention are suitable for this application. Hand recall information is useful when the game requires a fixed number of cards dealt to each player, and the final hand is determined at the point that the hand is dealt.

Upon conclusion of a hand of play in the underlying game, step 152, the CTGS automatically resolves the wagers by adding or subtracting credits to the corresponding player accounts as appropriate. The dealer then cashes out the player at step 154, by zeroing out or resetting the player account and paying the player for any winnings or balance on the account in currency or casino gaming chips, depending on casino rules and/or gaming regulations.

At step 156, the CTGS calculates the handle, or number of hands, dealt per shift by the dealer. This information may be downloaded from the CTGS manually or networked with the house computer system to do this automatically.

As defined herein, a Chipless Gaming Table System (CGTS) is a traditional live table game experience on a semi-automatic gaming platform that includes credit wagering and the use of physical cards. Preferably, the system is used to monitor casino games played according to predetermined set(s) of rules, using at least one dealer. The CGTS includes a plurality of electronic player displays and touch screen wagering interfaces, the displays flush-mounted into the gaming table surface, wherein players place wagers and execute game decisions electronically on displays equipped with touch screen controls (e.g., liquid crystal display screens) and/or other touch screen forms of suitable user interface technology, while playing a live table game.

In a preferred embodiment, the CGTS includes a dealer PC/game server (hereinafter "game controller"), wherein the game controller is located where it is easily accessed by the dealer, for example, through a dealer interface system, which may be in front of the dealer, to the side of the dealer (on or associated with the table) and/or in a chip tray.

Preferably, the game controller is operatively associated with an intelligent card-handling and/or card-reading device located on the table. The device preferably has card-reading capabilities. The intelligent card-handling device (i.e., a card-reading shoe or shuffler) correlates read card rank and suit information with known stored card values and transmits the correlated card data to the game controller for use in administering the game. Although card-handling devices that read special card markings on cards can be used as a part of the disclosed systems, it is preferred that the intelligent card-reading devices read the standard rank and/or suit markings on conventional playing cards, eliminating the need for the casino to use specially marked cards. However, card-handling devices of the present invention can be designed to read special markings, such as a casino marker, a lot number, a serial number, a deck code, a manufacturer code, and other markings.

The game controller is preferably programmed with the rules of the game (and, optionally, other games) being executed at a table, wherein the game controller receives and correlates the card information received from the card-handling device with the game rules and determines a game outcome(s) based on the actual dealt card values. The game controller is in communication with a plurality of electronic wagering interfaces, wherein each electronic wagering interface transmits and receives updated game and wagering information as each game progresses and as each game is eventually concluded. Preferably, players may enter game play decisions as well as wagering decisions on the player interfaces.

Figure 6:
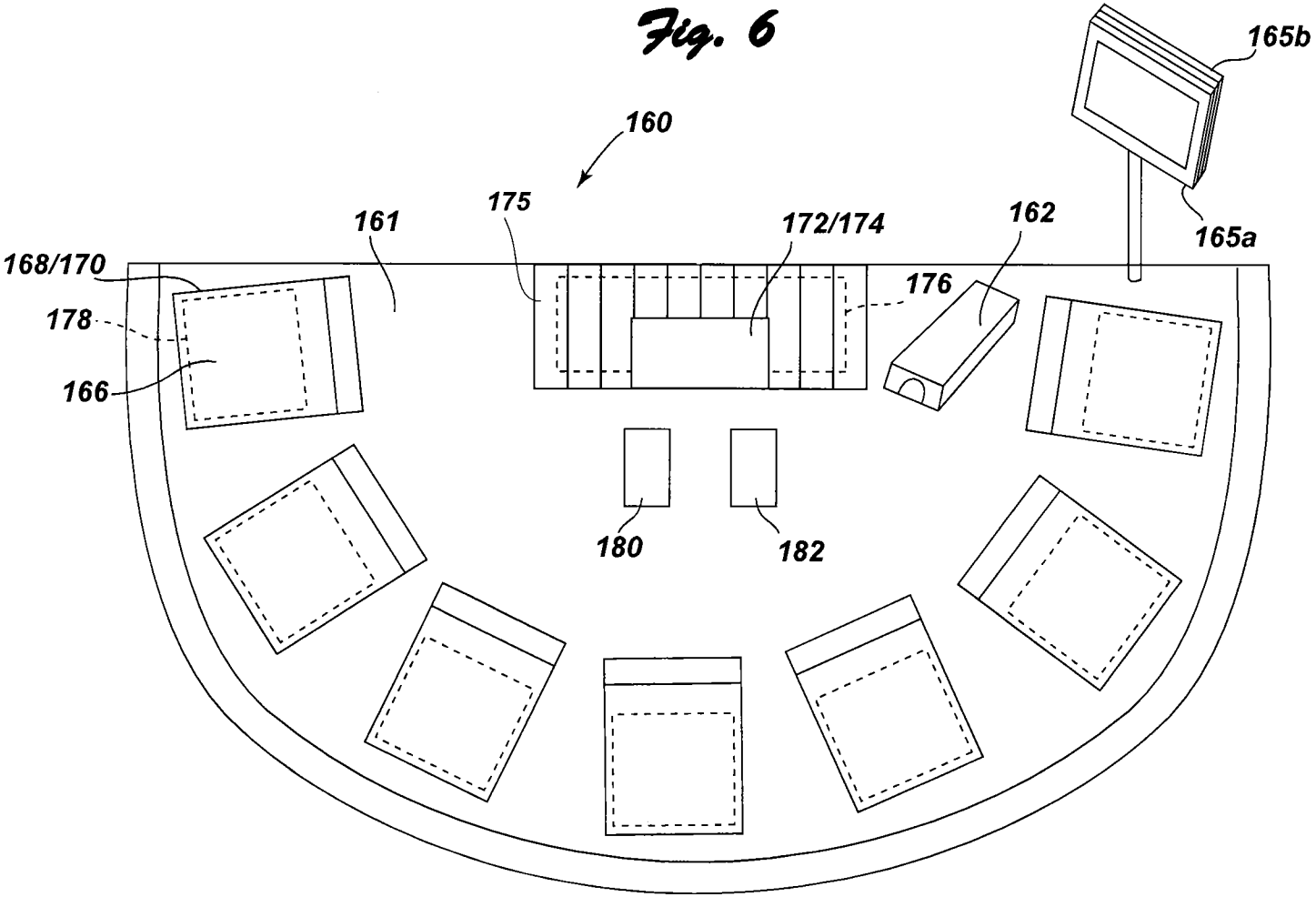
FIG. 6 shows an embodiment of a chipless gaming table described herein.

One preferred embodiment of a player display for the CGTS features LCD touch screen technology, but plasma and/or other suitable technology may be employed as desired. Preferably, a plurality of displays with touch screen controls are flush mounted into a gaming table surface at each player position, as shown in FIG. 6. FIG. 6 shows an exemplary chipless gaming system 160 that includes a gaming table surface 161. Embedded in the gaming table surface 161 in player areas 166 are flush-mounted player displays 168 with touch screen interfaces 170 superimposed on the player displays 168. Beneath the gaming table surface 161 is a player processor 178 (shown in phantom). Each player area 166 is equipped with the same equipment.

Areas 180 and 182 are designated for dealer cards, community cards or any other card that is used in the game but that is not assigned to a single player. In order to allow players to cash in and cash out with chips, a chip tray 175 is provided. The chip tray 175 also helps to make the chipless table 160 appear more like a standard gaming table. Players may cash in with chips, currency or credit. The dealer inputs the buy-in on dealer screen 172 and touch screen controls 174 and this information is transmitted to a game controller 176 (shown in phantom and located beneath the gaming table surface 161). A money drop slot (not shown) is provided on the gaming table surface 161 to allow the dealer to easily deposit paper money bills thereinto when players purchase credits.

Figure 7:
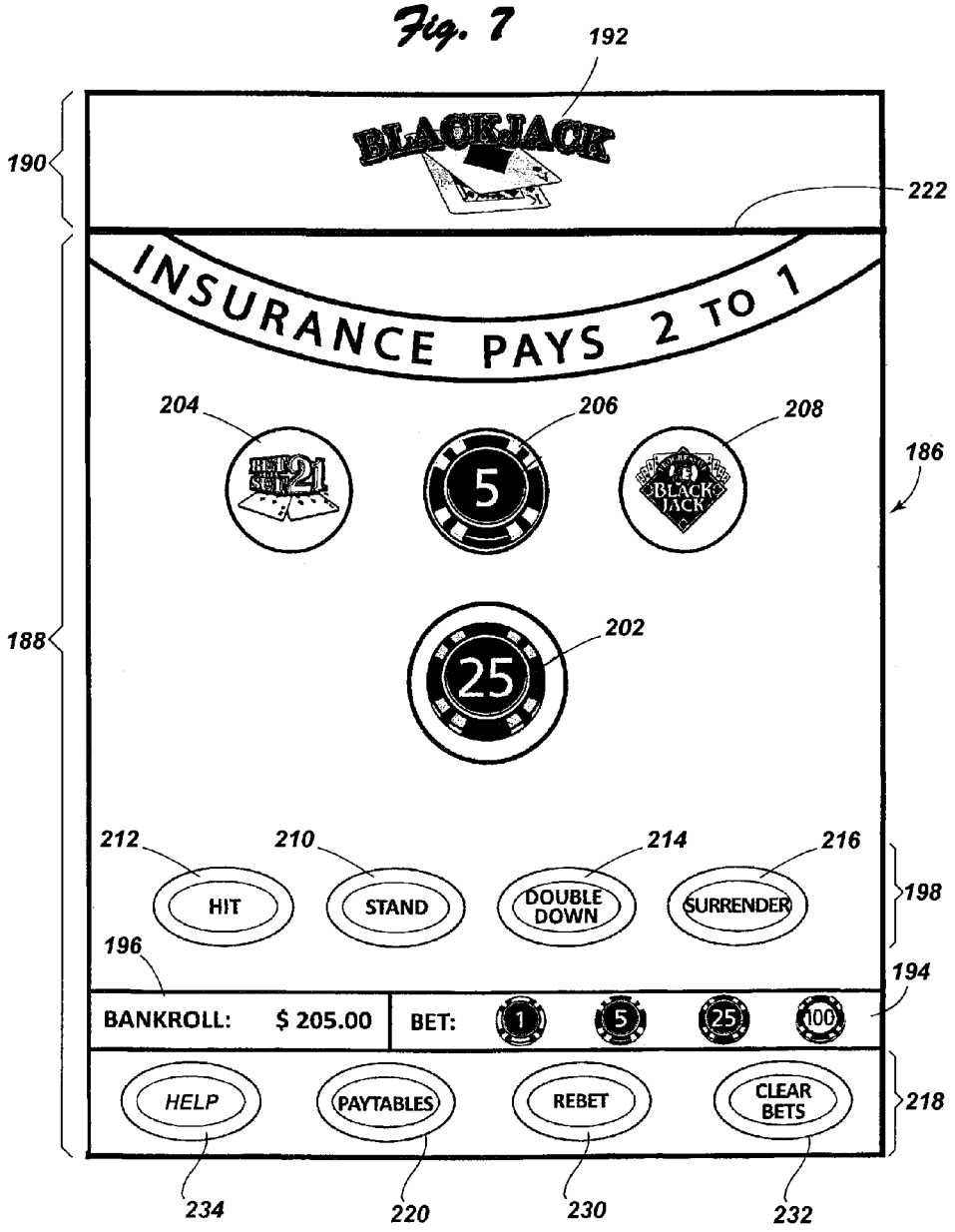
FIG. 7 is an exemplary player display of the chipless gaming table, enabling the play of blackjack and various blackjack side bets.

FIG. 7 is an exemplary player display 186 of the CGTS, enabling the play of blackjack and various blackjack side bets. The player display 186 enables the player to input play decisions as well as wagering decisions. The player display 186 has a first player area 188 that is used by the player, and a second, separate dealer area 190 that is used primarily by the dealer, but can also be used by the player. In FIG. 7, a "blackjack" game designation 192 appears in the dealer area 190 and is used by the player to identify the game being played on the system.

The player area 188 includes player touch screen play controls 198, a bankroll area 196, a chip display area 194, an additional player control area 218, a game wager betting area 202 and three optional side bet areas 204, 206 and 208. To place a wager, the player touches a chip in chip display area 194 then touches the betting area 202 he wishes to wager on. If the player wants to make a wager of $25.00 for example, he may touch the $5.00 denomination chip representation and then touch betting area 202 five times. Alternatively, he may touch and tap or drag the $25.00 denomination chip, if available, in chip display area 194. In a preferred embodiment, the total wager is calculated and displayed on the top chip so that it is clear that the player is making a $25.00 wager. In other embodiments, the top chip includes a $5.00 designation but the chip is shown as a stack that is five chips high. The player may make a side wager by touching a chip in the chip display area 194 and then touching the side bet area 206, registering the $5.00 wager. The player may consult the side wager pay table by touching a "pay tables" button 220 located on the additional player control area 218.

Figure 8:
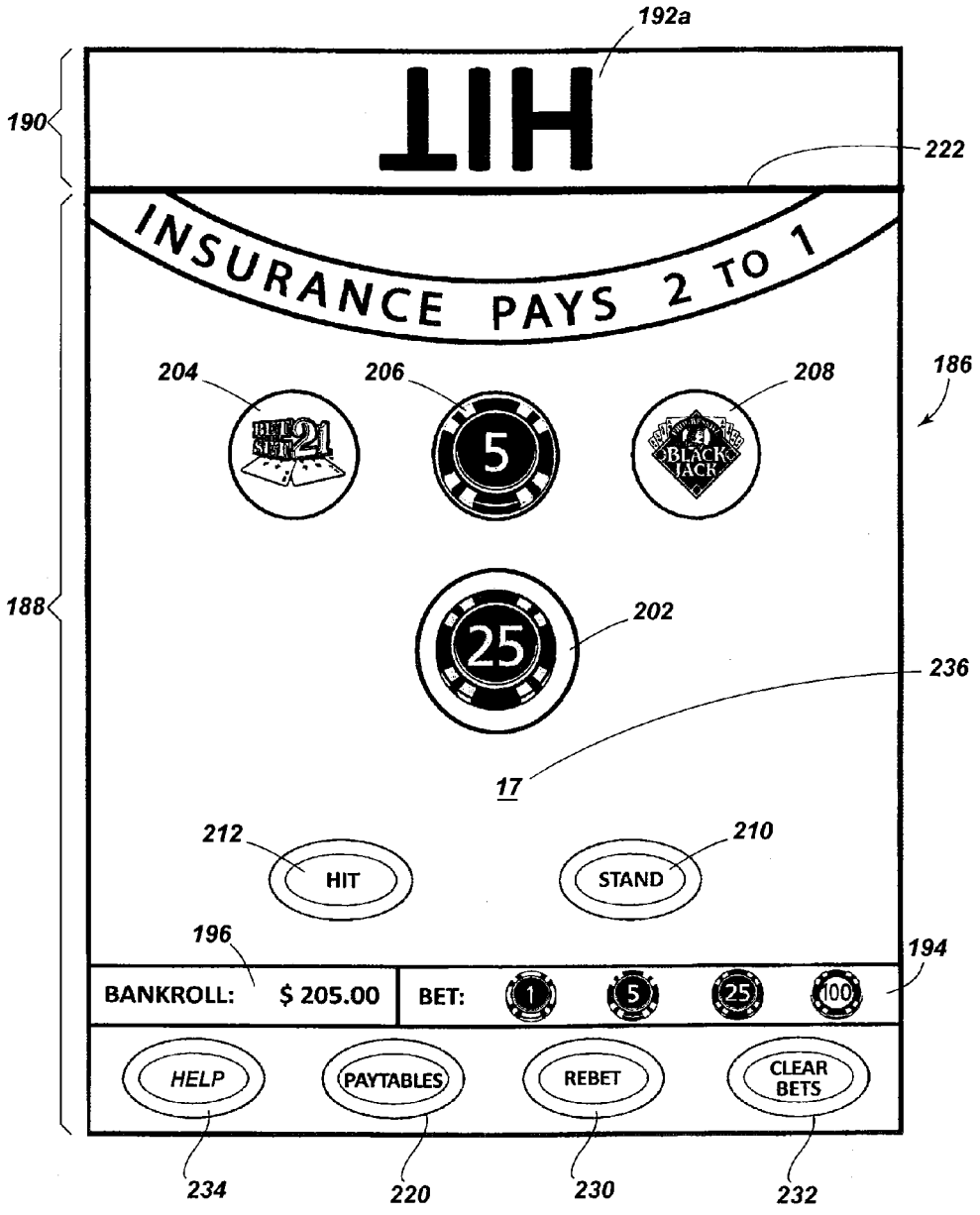
FIG. 8 shows a player display, wherein an executed player decision to "hit" is displayed in a dealer display area.

The touch screen play controls 198 of the player display 186 enables the player to input commands that are then carried out by the dealer. In the game of blackjack, the player may input a "stand" command 210, a "hit" command 212, a "double down" command 214 or a "surrender" command 216 using touch screen play controls 198. These commands are input by the player via the touch screen play controls 198 to the game controller 176 (see FIG. 6). Preferably, those commands are also displayed as instructions in the dealer area 190 of the player display 186 in an orientation readable by the dealer, as shown in FIG. 8. When the player inputs the hit command 212, the game controller displays a "hit" instruction 192*a* in an orientation readable by the dealer. The dealer sees the "hit" instruction 192*a* and responds by pulling a card out of a shoe 162 (shown in FIG. 6) and delivering the card to the player who input the "hit" command 212. The game controller receives a card rank and/or suit signal from the card-handling device (preferably a card-reading shoe), and the game controller now knows that the dealt card should be associated with the hand dealt to the player position that requested the hit card. Enabling the calling of cards or commands to "split" (not shown), "double down" 214, "hit" 212, "stand" 210 or "surrender" 216 similarly enables the game controller 176 to assemble hand information and associate that hand information with a particular player area 166 (FIG. 6). The player area 166 can be equipped with a separate or integrated player tracking system (not shown) of known configurations that enable the game processor to associate win/loss information with a particular player.

The dealer area 190 of the player display 186, in some embodiments, is used by the dealer to input game play decisions made by the house into the system. For example, if the game being played was pai gow poker, dealer area 190 could be used by the system to display the player's seven cards and allow the dealer to assist the player in setting the hand. The dealer could be instructed to "set hands" in dealer area 190. The dealer would touch either the five cards that define the high hand or the two cards that define the low hand. In one embodiment, the dealer can touch and drag cards to group them in the desired manner. In other embodiments, touching the cards defining one hand rearranges the cards on the display into set hands. The player must then arrange the physical cards to match the dealer instructions.

The touch screen is further enabled to allow the dealer to touch and drag cards from hand to hand, in the event that the dealer determines that the dealer's setting of the hand does not comply with the "house way." When the dealer area 190 is being used to instruct the dealer, the text is preferably inverted such that the information can be understood by the dealer. When the dealer area 190 is used to provide information to the player, the information is preferably oriented so that the player can readily understand the information. In one exemplary form of the invention, a separation line 222 is provided to divide the two display areas.

An essential feature of the player display 186 is a continuous touch screen control panel overlay, or control panel. The overlay preferably extends over the entire surface of the display. The display may be pressure-sensitive, heat-sensitive, moisture-sensitive, conductive or use any other known technologies to input decisions. In other examples of the invention, the touch screen controls cover only a portion of the display. The touch screen controls are configured to provide the player with controls to make wagers, input game play decisions, clear bets, repeat bets, rebet a same amount, and obtain information on how to play the game.

Figure 9:
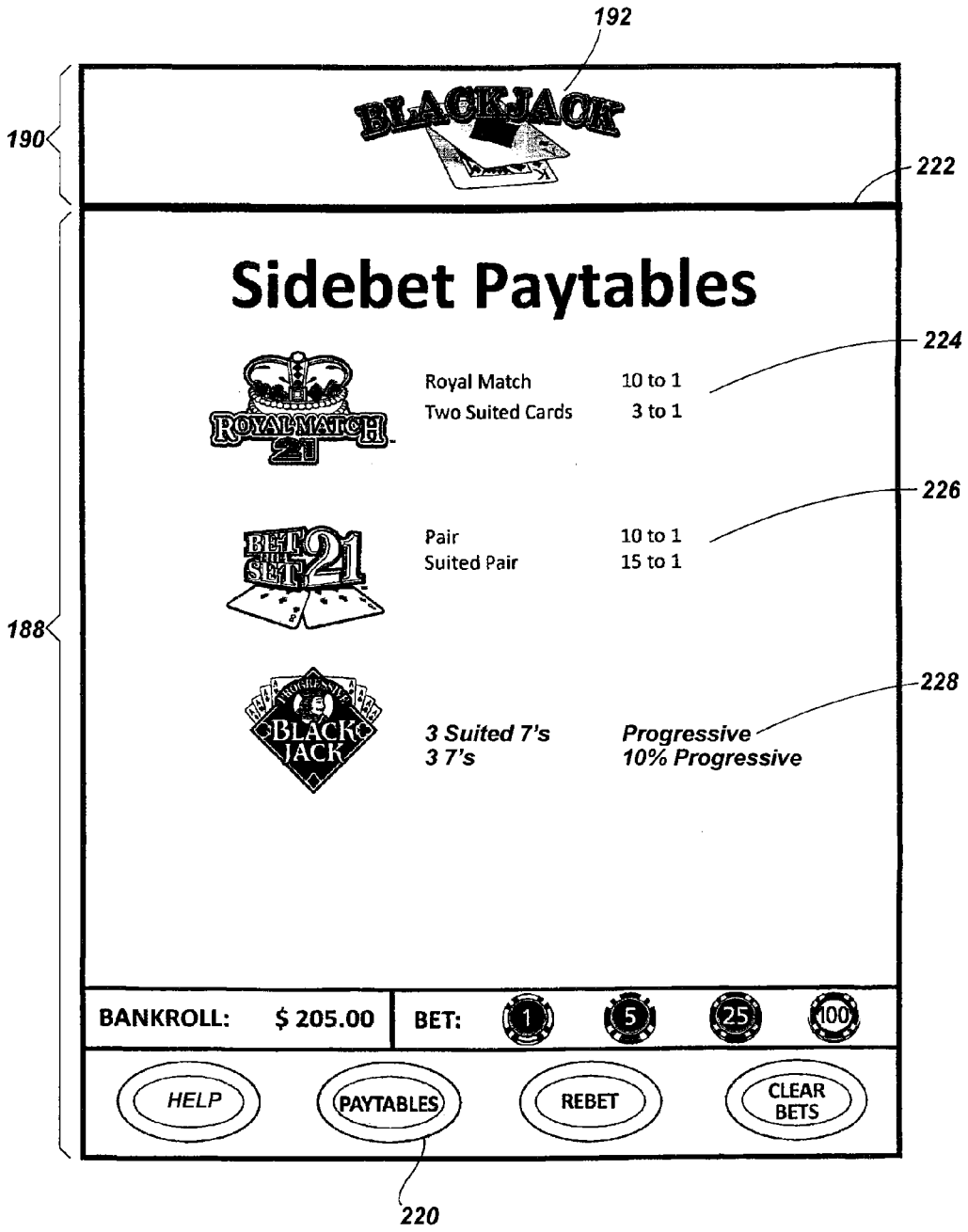
FIG. 9 shows a player display displaying available blackjack side bets in a player screen area, and an indication of the game in a dealer area.

The "pay tables" button 220 activates a screen, as shown in FIG. 9, that displays side bet pay tables 224, 226 and 228. The side bet pay tables 224, 226 and 228 show the predetermined card combinations that win a payout and corresponding payout odds, payout amounts, or progressive meter portions. Referring back to FIG. 8, a "rebet" button 230 allows a player to make the same size wager as made in the previous hand. A "clear bets" button 232 resets the player display 186 so that the player can make a new wager. A "help" button 234 is also provided to change the screen (not shown) and to provide a summary of the game rules, etc.

The information displayed on the player display 168 (FIG. 6) has a bankroll area 196 that displays the total number of credits the player has available for play. This amount includes the value of the chips in the player chip display area 194.

A preferred method of practice of the present technology is for both the dealer area 190 and player area 188 to be provided with picture-in-picture technology, whether in analog or digital format. Circuitry and processing support systems enabling this picture-in-picture format and picture-on-picture format are known in the video monitor and electronic imaging art, such as in U.S. Patent Application Publication Nos. 2008/0037628 to MacDonald et al., now U.S. Pat. No. 7,573,938, issued Aug. 11, 2009, 2007/0275762 to Aaltone et al., 2007/0256111 to Medford et al., now U.S. Pat. No. 8,412,774, issued Apr. 2, 2013, and 2004/0003395 to Srinivas et al.

Displaying the player's total card count in area 236 (FIG. 8) is possible when a chipless table is used in connection with an integrated card-reading shoe, card-reading shuffler or other card-reading device, such as an overhead camera imaging system. The card information is sent to the game processor and the data is used by the game processor to calculate a total card count which, in the illustrated example, is equal to 17. The game processor calculates the hand count and transmits the count to the player processor 178 associated with the player display 168 (FIG. 6). The game processor further instructs the player display 168 to display the count in area 236. The card hand total may optionally be presented on a communal player screen 165*a* facing the players and/or on a pit screen 165*b* facing the dealer (FIG. 6).

In alternate embodiments of the chipless table, the player controls are in the form of buttons and switches. Although it is not necessary to provide touch screen controls at the player or dealer stations, this type of user input is desirable because it can be reconfigured through reprogramming and no hardware components must be changed out to reprogram the system to administer different games.

An important feature of the chipless table is the dealer control component. The dealer screen 172 is located in the chip tray 175 and touch screen controls 174 are overlaid on the dealer screen 172 (as shown in FIG. 6). The dealer screen 172 may be used for a number of important functions. For example, the dealer touch screen controls 174 are used to assign buy-in credits to player stations. Bets can be locked out by touching a "deal" field on the dealer's touch screen controls 174. To commence play, the dealer removes the first card from the shoe 162. In one embodiment, once the first card is dealt, a plurality of new fields appear on each player's touch screen. The dealer screen 172 may be configured to display each player's wagers, each player's cards, each player's total hand count or any other game play information worthy of display.

Different communication and control relationships can exist between player and dealer input systems, game controllers, card-handling devices, display devices, casino computers, databases, and data storage media within a single casino or multiple casinos. The relationships are known within the communication-information technologies field as master-slave systems, thin client systems, client server systems and blended systems. The blended system is understood to be a system that is not fully master-slave (where a single dominant computer gives orders/commands to a slave subordinate computer or processor) or purely an input system (e.g., buttons only, cash input, and information signals only, without substantive commands being sent, and the like), nor is it a completely or substantially coequal system (peer-to-peer) where data processing and commands may be performed by multiple systems (multiple computers) with defined regions of control and authority. These differing relationships are contemplated by the present invention. In one exemplary form, the graphics functions are managed by the player processor, and all other functions are managed by the game CPU.

Underlying Architecture for Chipless Gaming Tables

Referring back to FIG. 6, a total of seven player displays 168 with touch screen interfaces 170 are shown. Each of the player displays 168 has a player processor 178 (shown in phantom) and a touch screen interface 170. There is also a game controller 176 (shown in phantom) whose location at the table system 160 is relatively unimportant, but which must be in direct (hardwired or wireless or networked) communication with each player processor 178 and a card-reading and/or card delivery system 162 from which playing cards are supplied, with at least the rank/count (and preferably also suit) of individual cards known as the cards are removed (for example, one at a time) and delivered to player areas 166 and/or the dealer position. The card delivery system 162 is in communication with the game controller 176 by wired or wireless communication methods. The player processors 178 could also be in communication link with the game controller 176 by wireless or hardwired connections. Communication is not limited to electronic or electrical signals, but may include optical signals, audio signals, magnetic transmission, and the like.

The individual player processors 178 are preferably graphics processors, and not full-content CPUs, as a cost-saving, space-saving, and efficiency benefit. With the reduced capacity in the processor as compared to a CPU, there is actually a reduced likelihood of tampering and fraudulent input.

The individual components provided for functionality at each position (e.g., the slave, servant, coequal, or master functionality) are not limited to specific manufacturers or formats, but may be used according to general performance requirements. It is not even necessary that identical computing formats (MAC®, PC, LINUX®, etc.) be used throughout the system, as long as there is an appropriate I/O communication link and language/format conversion between components. Further discussion of the nature of the various components, including definitions therefor, will be helpful.

Flash memory (sometimes called "Flash RAM") is a type of constantly powered non-volatile memory that can be erased and reprogrammed in units of memory called "blocks." It is a variation of electrically erasable programmable read-only memory (EPROM) that, unlike Flash memory, is erased and rewritten at the byte level, which is slower than Flash memory updating. Flash memory is often used to hold control code, such as the basic input/output system (BIOS) in a personal computer. When BIOS needs to be changed (rewritten), the Flash memory can be written to in block (rather than byte) sizes, making it easy to update. On the other hand, Flash memory is not useful as random access memory (RAM), because RAM needs to be addressable at the byte (not the block) level. Flash memory gets its name because each microchip is organized so that a section of memory cells are erased in a single action or "flash." The erasure is caused by Fowler-Nordheim tunneling, in which electrons pierce through a thin dielectric material to remove an electronic charge from a floating gate associated with each memory cell. The Intel Corporation (Santa Clara, Calif.) offers a form of Flash memory that holds two bits (rather than one) in each memory cell, thus doubling the capacity of memory without a corresponding increase in price. Flash memory is a non-volatile computer memory that can be electrically erased and reprogrammed. It is a technology that is primarily used in memory cards and USB Flash drives (thumb drives, handy drives, memory sticks, Flash sticks, jump drives, currency sensors, optical sensors, credit entries, and other signal generators) for general storage and transfer of data between computers and other digital products. It is often considered a specific type of EEPROM (Electrically Erasable Programmable Read-Only Memory) that is erased and programmed in large blocks; in early Flash, the entire chip had to be erased at once. Flash memory has also gained popularity in the game console market, where it is often used instead of EEPROMs or battery-powered SRAM for game save data.

The phrase "non-volatile" means that it does not need power to maintain the information stored in the chip. In addition, Flash memory offers fast read access times (although not as fast as volatile DRAM memory used for main memory in PCs) and better kinetic shock resistance than hard disks. These characteristics explain the popularity of Flash memory in portable devices. Another feature of Flash memory is that, when packaged in a "memory card," it is enormously durable, being able to withstand intense pressure, extremes of temperature, and immersion in water. Although technically a type of EEPROM, the term "EEPROM" is generally used to refer specifically to non-Flash EEPROM, which is erasable in small blocks, typically bytes. Because erase cycles are slow, the large block sizes used in Flash memory erasing give it a significant speed advantage over old-style EEPROM when writing large amounts of data. Non-volatile memory (NVM), or non-volatile storage, is computer memory that can retain the stored information even when not powered. Examples of non-volatile memory include read-only memory (ROM, flash memory, most types of magnetic computer storage devices (e.g., hard disks, floppy disk drives, and magnetic tape), and optical disc drives. Non-volatile memory is typically used for the task of secondary storage, or long-term persistent storage. The most widely used form of primary storage today is a volatile form of random access memory (RAM), meaning that, when the computer is shut down, anything contained in RAM is lost. Flash memory may also be provided in chips, field-programmable gate arrays (FPGAs), ASICs and Magnetic RAM (MRAM). The latter would allow for computers that could be turned on and off almost instantly, bypassing the slow start-up and shutdown sequence.

The "chipless gaming table" format and architecture described herein comprise generic concepts and specific disclosures of components and subcomponents useful in the practice of the present technology. It should be appreciated at all times that equivalents, alternatives and additional components, functions and processes may be used within the system without deviating from the enabled and claimed technology of this invention.

The semi-automatic gaming platform preferably is reconfigurable so that different games can be played. If the platform is being reconfigured from a "shoe" game to a "shuffler" game, shoe 162 (FIG. 6) must be replaced with a shuffler, or, if the game is hand-pitched, with an overhead camera imaging system.

Communication Interfaces

As noted earlier, the communication interfaces may be client-server, master-slave, peer-to-peer and blended systems, with different relationships among the various processors and CPUs as designed into the system.

Any allowable communication standard (jurisdictionally, by state, county and/or Federal laws and regulations) may be used as the communication standard, with FTP or HTTP standards being the most common and acceptable, but not exclusive, formats used. Each of the computers and processors used may include a display and a number of input buttons, or touch screen functions, and combinations of these, with wired or wireless communication links to enable the player to initiate actions or make responses as required during the game. In a game where the player is playing against the house, the player's hand is displayed face up on the screen as it is dealt and the house hand may be shown face down on the screen. Touch "buttons" can be provided on the screen in addition to or instead of physical buttons. In a further non-limiting configuration, one or more of the players can be located in separate locations, and the player terminals or hand-held devices or player screens in separate locations can be connected to the controller via communication links (e.g., hardwired or wireless links). Standard protocols, software, hardware and processor languages may be used in these communication links, without any known limitation. There are hundreds of available computer languages that may be used, among the more common being Ada, ALGOL, APL, awk, BASIC, C, C++, COBOL, DELPHI®, EIFFEL®, Euphoria, Forth, Fortran, HTML, Icon, JAVA®, JAVASCRIPT®, Lisp, Logo, MATHEMATICA®, MATLAB®, Miranda, Modula-2, Oberon, Pascal, PERL®, PL/I, Prolog, PYTHON®, Rexx, SAS®, Scheme, sed, Simula, Smalltalk, SNOBOL, SQL, VISUAL BASIC®, VISUAL C++®, and XML.

Any commercial processor may be used either as a single processor, or in a serial or parallel set of processors. Examples of commercial processors include, but are not limited to MERCED™, PENTIUM®, PENTIUM II XEON™, CELERON®, PENTIUM PRO™, EFFICEON®, ATHLON®, AMD® and the like.

Display screens may be segment display screens, analog display screens, digital display screens, CRTs, LED back-lit screens, plasma screens, liquid crystal display screens, and the like.

Example 1

Dealing a Card not Called for

Examples of card-handling devices of the present invention have the capability to stop the delivery of cards. The instruction to stop card delivery can come from the processor that controls the card-handling device or from a separate processor.

The following are examples of conditions in which it is useful to stop cards from advancing, particularly when the card-handling device is a mechanized shoe and when the shoe is integrated into a CGTS.

The following play situation and sequence of events will assist in an appreciation of conditions that would desirably trigger the card-handling device to cease advancing cards. The game of blackjack will be used in the following examples.

Three players have placed blackjack wagers. The dealer pulls cards one at a time from the delivery shoe and provides each player with two cards face down that define initial or partial hands. The dealer deals himself a two-card hand, one card face up.

Play begins with a first player. The first player holds a two-card 11 and inputs a "hit" command. The dealer removes a card from the shoe and delivers it to the first player face up. The point total is now 13. Before the first player decides whether to hit or stand, the dealer deals the first player another card face up. The system knows that the hit card was dealt in error, because no cards were called for. The game controller senses the condition and instructs the card-moving system to cease card delivery. An error message appears on the dealer area of the player display as well as on the dealer display.

In the meantime, the dealer has asked a second player if he wants a hit card. The second player inputs a hit command. The hit command does not register because the misdeal condition at the first player's position has not been resolved. The dealer is required to go back to the first player and resolve the misdeal condition. The dealer calls the pit boss and explains that a card was dealt prior to a request for a card. After the pit boss issues instructions to resolve the error, the dealer must reset the system so that card delivery resumes.

Example 2

Dealing Cards Face Up Instead of Face Down

Two players place a wager. The dealer deals two cards face down to the first player, and two cards face up to the second player. The second player immediately complains that his cards were revealed to the other player. In the meantime, an overhead imaging system senses that the cards were erroneously dealt face up, and the game controller instructs the card-handling device to cease moving cards. The dealer calls the pit boss, and when the play error is resolved, the dealer inputs a "reset" command into the dealer interface, which enables the card-handling device to resume moving cards to a delivery end.

Other Misdeal Examples

Although dealing errors are not the only portion of the many conditions that require the card-handling device to cease moving cards, they are a common reason why a casino would want to limit the number of unassigned cards on a casino gaming table. Non-limiting examples of dealer misdeals include: dealing a card when the player or the rules of the game do not require a card; dealing a card to the wrong player; dealing a card to a common area; and dealing a card face up where the player is entitled to receive the card face down.

When a card is inadvertently dealt face up, the player whose card was misdealt will usually protest (unless the card is a highly beneficial card). When this happens, play immediately stops. The dealer apologizes to the player(s) and, preferably, calls a pit boss (supervisory personnel at the casino). The dealer tells the pit boss he misunderstood the player(s), and misdealt a card(s) to the player(s) or dealt the cards in an incorrect manner. The misdealt card and/or cards may be burned, which is a typical house rule. The player(s) is given a chance to make a new game decision if desired. The playing cards are re-dealt relative the player's game decision (s). Game play then resumes.

Example 3

In the game of baccarat, the shoe of the present invention is controlled by a processor that includes the game rules. Dealers deal between four and six cards in one round. The rules of the game determine whether or not a third card is drawn to each hand and, since the cards are read, the game rules determine whether four, five or six cards are to be drawn. The game outcome is determined by applying the game rules to the cards as they are read. In one exemplary shoe, the game rules reside on a processor internal to the shoe. In other embodiments, the game rules reside on an external computer that communicates with the processor internal to the shoe.

In this example, the dealer inadvertently pulls out six cards when the game rules require that five cards are used. The processor recognizes this predetermined condition as an "overdraw" error and issues an alarm. In this embodiment, if the cards become intermixed before the dealer sets the hands, the player hand and banker hand are displayed on the shoe display, viewable only by the dealer, to assist the dealer in setting the hand. The card that is left is the card that was overdrawn. In other embodiments, the overdrawn card is also displayed and identified by the processor as the overdrawn card.

The overdrawn card at this point has most likely been revealed to the players, so the dealer calls the floor supervisor or pit boss who inputs a "burn" command into a touch screen control on the display and the dealer discards the excess card. If the card value has not been revealed to the players, the floor supervisor may instead instruct the dealer to use the card as part of the next hand. The floor supervisor may input this decision on the touch screen display by touching a "use" button on the touch screen control. In one preferred example of the invention, a burn/use option appears on the dealer display each time a card is drawn in error.

In some embodiments of the shoe, the dealer display provides a burn/use option even when no card draw error is detected. If, for example, the house adopts a procedure to burn a first card prior to dealing each hand of baccarat, the dealer may select the burn option, in which case that card is not used to determine game play outcome. This option may be implemented in software, hardware, or both software and hardware. When the option is implemented using hardware, physical burn and/or use switches or buttons may be provided. When the option is implemented in software, the burn and/or use commands may be entered by the dealer (or pit boss) via the touch screen control on the dealer display at the rear of the shoe. This same feature may be provided on a card-reading shuffler of the type that provides for delivery of hands, partial hands or individual cards.

In the event that a card foreign to the recognized set of cards is drawn from the shoe, exemplary systems of the present invention issue an alarm indicating that the card is invalid or unknown, triggering the system to stop card movement until the error is resolved. This type of alarm might also be sent to the pit boss or to the control center to initiate an investigation of how the card was placed in the shoe and might also focus "eye in the sky" cameras on the table. For instance, if the shoe initially holds eight decks of cards, when a ninth ace of spaces is drawn, an alarm issues indicating an invalid or unexpected card was drawn. Or, if a different brand of cards with slightly different rank and suit graphics is read, an alarm might issue. If the cards have special markings and one card lacks those markings, an alarm might issue.

It is preferable to issue the alarm at a time when the invalid card is drawn, as opposed to when the card is being read. Delaying the alarm until the card actually comes onto the table offers the advantage of not interrupting valid play.

In other embodiments, the burn/use option may be used to correct detected card-reading errors, the errors occurring from a variety of different reasons. Examples of card-reading errors range from sensor/processor malfunction (i.e., reading an ace of hearts as a ten of spades), to being unable to recognize a read card (blank card stock, a brand of cards that has the rank/suit markings in a different location, reading a joker when the data file of expected card values does not include jokers, not recognizing promotional cards, cut cards, bonus cards, etc.), to recognizing cards that are not part of the expected set of cards (i.e., reading the fifth ace of spades in a four-deck shoe, reading an ace of spades with different deck markings or different manufacturer markings, or reading an ace of spades that has a different appearance, such as different color or size of the markings, because the card is not from the same manufacturer). These errors are all collectively referred to as card-reading errors, even though the reason an error signal is generated does not always mean the card recognition system is not functioning correctly.

Example of a Process Enabling Error Correction in a Running Inventory File

Figure 10:
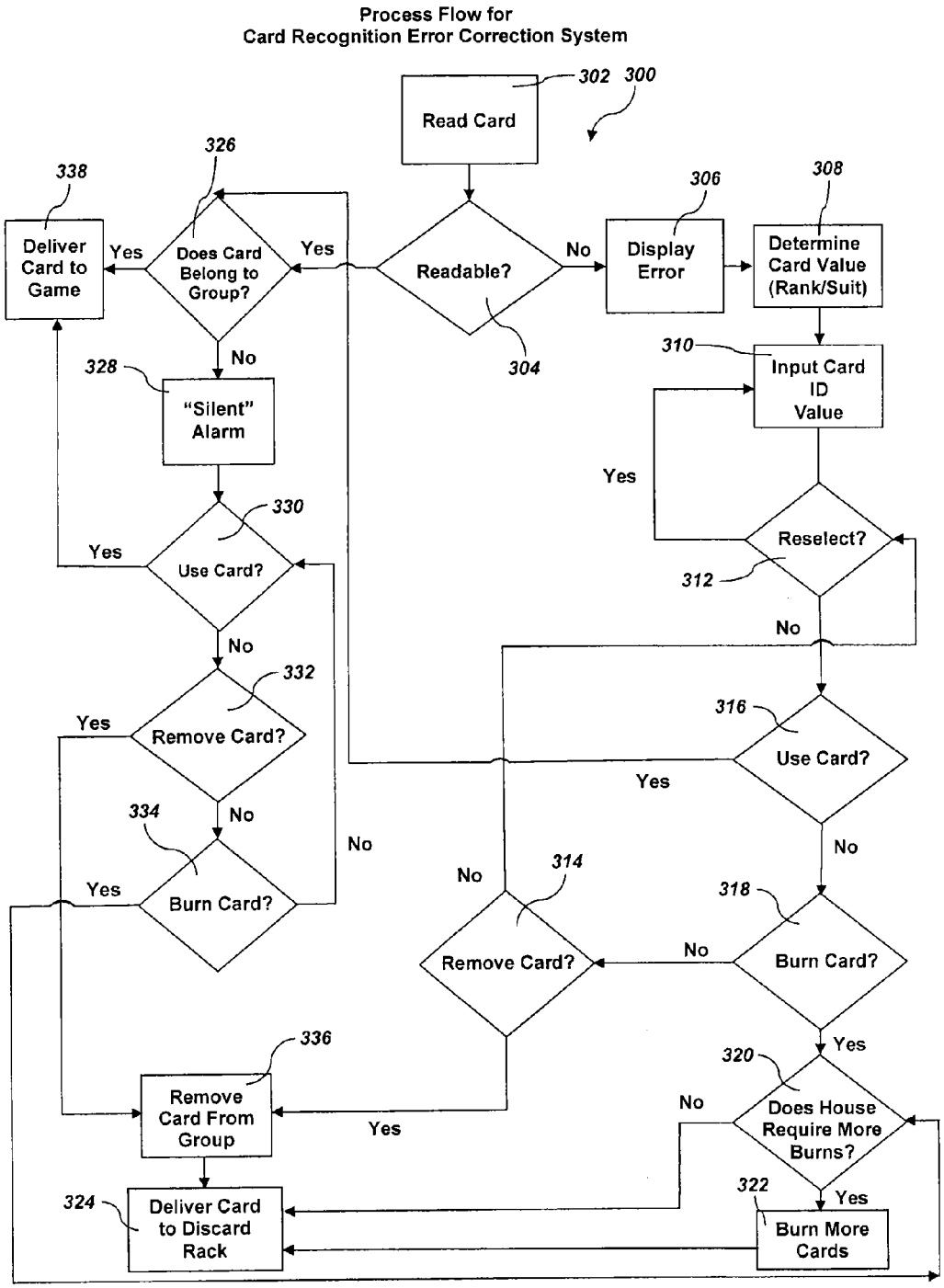
FIG. 10 is a flowchart showing one example of an inventory error correction system of the present invention.

An exemplary process 300 of recognizing and correcting errors in card-handling systems of the present invention is shown in FIG. 10. The exemplary process 300 begins with a read card step 302. As a first step, the system must first determine if the card is readable at decision block 304. The card might not be readable because it is upturned or smudged, or because the system is not configured to read the card (e.g., a joker or a card from a different manufacturer, etc.). If the card is not readable, an error is displayed at step 306. The error prompts the user to examine the card and manually determine the card value at step 308. Once the card value (i.e., jack of clubs) has been determined at step 308, the card value is input into the system at step 310. Once the user inputs the card value at step 310, the system displays a reselect option 312 and the user has the opportunity to change the input value of the card.

According to the exemplary process 300, the user is prompted to decide whether or not to use the card at decision block 316. If the user decides not to use the card, he must next decide whether to burn the card at decision block 318 or remove the card at decision block 314. Burned cards are part of the running inventory while removed cards are not.

In one embodiment, the exemplary process 300 continues by asking the user if he wishes to burn additional cards at decision block 320. If the answer is yes, the user pulls out a desired number of burn cards at step 322 and delivers the cards to a discard area, such as a discard rack at step 324. If the dealer does not wish to burn additional cards, only one burn card is delivered to a discard area at step 324.

A decision to use read cards that were not removed from the game at step 336 or burned at step 322 is made at decision block 316. The system determines at decision block 326 if the cards belong to the group of expected cards and, optionally, the card is also compared to the running inventory to verify that the card is not an extra card or a card that is not part of the expected set (not shown in FIG. 10). If the card is not expected, a silent alarm is activated at step 328. The silent alarm alerts casino personnel of a potential problem and a decision is made at decision block 330 whether to use the card or not to use the card. If the card is not used, the dealer or casino pit manager must decide whether to burn the card at decision block 334 or remove the card at decision block 332. Removed cards are removed from the running inventory while burned cards remain in the running inventory. If the house or dealer decides to use the card at decision block 330, the card is delivered to the game at step 338.

Other suitable methods to control the processes for assuring only validated cards enter the game may be used. For example, the process may provide only the choice of using or burning each card, rather than using, burning or removing each card. Cards may be delivered to the game without having been read when the supervisor permits the dealer to disable the card-reading feature. The error display may be a secret display, which does not alert the player to any abnormal condition, or the error may cause an alarm that does alert the players to an abnormal condition. Card IDs may be selected from a menu of available card values, or the information may be keyed in on an-alphanumeric key pad. The device may be configured using symbolic selectors, or-alphanumeric selectors. The instructions may be written in one or more languages, and the software may provide different language settings to accommodate casino personnel who speak foreign languages. The above description is only intended to provide examples of methods and devices of the present invention and is not intended to limit the scope of the claims in any manner.

What is claimed is:

1. A method of identifying unexpected cards in a card-handling device, comprising:

determining identifying information of a card utilizing a card recognition system of the card-handling device;

adding the determined identifying information to a running inventory of identifying information for detected cards in a memory of the card-handling device;

comparing at a processor of the card-handling device the running inventory to a database of identifying information correlating to a set of expected cards;

generating at the processor an alert signal indicating that the identifying information for the card is not in accordance with the set of expected cards;

receiving a signal at the processor from a user input of the card-handling device indicating that the detected card was removed from play after it was withdrawn from the card-handling device; and responsive to the signal, removing the identifying information for the card from the running inventory in the memory utilizing the processor.

2. The method of claim 1, wherein the determining the identifying information of the card comprises determining the identifying information while the card is withdrawn from a shoe of the card-handling device.

3. The method of claim 1, further comprising selecting the database of identifying information correlating to a set of expected cards to comprise identifying information correlating to between four and eight standard decks of playing cards.

4. The method of claim 1, wherein generating the alert signal comprises generating the alert signal indicating that the identifying information for the card correlates to at least one of a blank card, a joker, an extra card, an oversupplied card, a specially marked card, a promotional card, a cut card, and a bonus card.

5. The method of claim 1, further comprising generating an error signal when the card recognition system fails to read identifying information for a card.

6. The method of claim 1, further comprising communicating the identifying information for the card from the processor, through an I/O port, to at least one of an external processor, an external data storage device, and a network device.

7. The method of claim 1, wherein comparing at the processor the running inventory to the database of identifying information correlating to the set of expected cards comprises determining that a quantity of cards in the running inventory of the same identifying information as the identifying information of the card is greater than a maximum expected quantity.

8. The method of claim 1, further comprising:

determining identifying information of another card utilizing the card recognition system;

adding the determined identifying information to the running inventory in the memory;

comparing at the processor the running inventory to the database of identifying information correlating to the set of expected cards;

generating at the processor another alert signal indicating that the identifying information for the other card is not in accordance with the set of expected cards;

receiving another signal at the processor from the user input indicating that the detected card was used or burned after it was withdrawn from the card-handling device; and responsive to the other signal, leaving the identifying information for the card in the running inventory in the memory and adding an indication that the card was used or burned to the running inventory in the memory.

9. The method of claim 8, further comprising determining a game outcome utilizing the processor and the running inventory, wherein identifying information correlating to cards that are burned or removed is not used in determining the game outcome.

10. The method of claim 1, further comprising:

comparing the running inventory to the set of expected card values when all unused cards are removed from the card-handling device; and generating a signal indicative of an inconsistency between the running inventory and the database of identifying information correlating to the set of expected cards.

11. A card-handling device configured to identify unexpected cards in the card-handling device, comprising:

a card input area;

a card storage area configured to temporarily store cards received from the card input area;

a card output area configured to receive cards from the card storage area and to enable manual removal of cards from the card output area;

a processor operatively connected to a memory, a database of identifying information correlating to a set of expected cards being stored in the memory;

a card recognition system configured to detect identifying information of a card, the card recognition system operatively connected to the processor; and a user input configured to receive a user election indicative of an action taken by the user after withdrawing a card from the card output area, the user input operatively connected to the processor, wherein the processor is programmed to:

add identifying information of a card from the card recognition system to a running inventory of identifying information for detected cards in the memory;

compare the running inventory to a database of identifying information correlating to a set of expected cards;

generate an alert signal indicating that the identifying information for the card is not in accordance with the set of expected cards; and remove the identifying information for the card from the running inventory in the memory when a signal indicating that the detected card was removed from play after it was withdrawn from the card-handling device is received at the processor from the user input.

12. The card-handling device of claim 11, further comprising an alert indication device configured to provide at least one of a visual alert and an audible alert when the alert signal indicating that the identifying information for the card is not in accordance with the set of expected cards is generated, the alert indication device being operatively connected to the processor.

13. The card-handling device of claim 11, wherein the processor is further programmed to leave the identifying information for the card in the running inventory in the memory and add an indication that the card was used or burned to the running inventory in the memory when another signal is received at the processor from the user input indicating that the detected card was used or burned after it was withdrawn from the card-handling device.

14. The card-handling device of claim 13, wherein the processor is further programmed to determine a game outcome utilizing the running inventory, wherein identifying information correlating to cards that are burned or removed is not used in determining the game outcome.

15. The card-handling device of claim 11, further comprising an I/O port configured to communicate the identifying information for the card from the processor to at least one of an external processor, an external data storage device, and a network device.

16. The card-handling device of claim 11, wherein the processor is programmed to determine whether a quantity of cards in the running inventory of the same identifying information as the identifying information of the card is greater than a maximum expected quantity.

17. The card-handling device of claim 11, wherein the output area comprises a shoe and wherein the card recognition system is located within the shoe, the card recognition system being positioned to determining the identifying information while the card is withdrawn from the shoe.

18. The card-handling device of claim 11, wherein the processor is programmed to generate the alert signal to indicate that the identifying information for the card correlates to at least one of a blank card, a joker, an extra card, an oversupplied card, a specially marked card, a promotional card, a cut card, and a bonus card.

19. The card-handling device of claim 11, wherein the processor is programmed to:

compare the running inventory to the set of expected card values when all unused cards are removed from the card-handling device; and generate a signal indicative of an inconsistency between the running inventory and the database of identifying information correlating to the set of expected cards.

20. The card-handling device of claim 11, wherein the database of identifying information correlating to the set of expected cards comprises identifying information correlating to between four and eight standard decks of playing cards.

* * * * *